US005608432A

United States Patent [19]

Yamaguchi

[11] Patent Number: 5,608,432

[45] Date of Patent: Mar. 4, 1997

[54] INK JET APPARATUS AND RECOVERY MECHANISM THEREFOR

[75] Inventor: Hideki Yamaguchi, Yokohama, Japan

[73] Assignee: Canon Kabushiki Kaisha, Tokyo, Japan

[21] Appl. No.: 262,273

[22] Filed: Jun. 20, 1994

[30] Foreign Application Priority Data

| | | | |
|---|---|---|---|
| Jun. 22, 1993 | [JP] | Japan | 5-150772 |
| Dec. 14, 1993 | [JP] | Japan | 5-342348 |

[51] Int. Cl.[6] ..... B41J 2/165

[52] U.S. Cl. ..... 347/33; 347/22

[58] Field of Search ..... 347/33, 29, 30, 347/22, 44

[56] References Cited

U.S. PATENT DOCUMENTS

| | | | |
|---|---|---|---|
| 4,313,124 | 1/1982 | Hara | 347/57 |
| 4,345,262 | 8/1982 | Shirato et al. | 347/10 |
| 4,459,600 | 7/1984 | Sato et al. | 347/47 |
| 4,463,359 | 7/1984 | Ayata et al. | 347/56 |
| 4,558,333 | 12/1985 | Sugitani et al. | 347/65 |
| 4,608,577 | 8/1986 | Hori | 347/66 |
| 4,723,129 | 2/1988 | Endo et al. | 347/56 |
| 4,740,796 | 4/1988 | Endo et al. | 347/56 |
| 4,819,012 | 4/1989 | Kiyohara et al. | 347/30 |
| 4,893,138 | 1/1990 | Terasawa et al. | 347/30 |
| 4,951,066 | 8/1990 | Terasawa et al. | 347/30 |
| 5,153,613 | 10/1992 | Yamaguchi et al. | 347/30 |
| 5,182,582 | 1/1993 | Okamura | 347/33 |

FOREIGN PATENT DOCUMENTS

| | | | |
|---|---|---|---|
| 54-056847 | 5/1979 | Japan . | |
| 9045162 | 3/1984 | Japan | 347/33 |
| 59-123670 | 7/1984 | Japan . | |
| 59-138461 | 8/1984 | Japan . | |
| 60-071260 | 4/1985 | Japan . | |

*Primary Examiner*—John E. Barlow, Jr.

*Attorney, Agent, or Firm*—Fitzpatrick, Cella, Harper & Scinto

[57] ABSTRACT

A recovery mechanism for an ink jet apparatus having a cap for capping the discharge ports of the ink jet head comprises means for cleaning the surface of the cap on the head side. This surface of the cap is cleaned to remove dust particles, paper fluffs and others adhering thereto before capping the ink jet recording head by the cap, thus assuring the air-tightness between the cap and the ink jet head by capping for the prevention of ink from being dried as well as for more reliable recovery of the ink jet head by sucking ink from the discharge ports thereof.

18 Claims, 17 Drawing Sheets

INK JET APPARATUS AND RECOVERY MECHANISM THEREFOR

BACKGROUND OF THE INVENTION

1. Field of the Invention

The present invention relates to a capping mechanism for an ink jet head applicable to a method and an apparatus for ink jet recording of a scanning type, a full-line type, or others which utilize ink jet recording, and to an ink jet apparatus equipped with such a mechanism. The present invention is applicable to various apparatuses having a function to record on a transparent recording medium such as paper, cloth, or sheet and others for OHP use in a liquid ink or ink in a state that a solid ink is liquefied (hereinafter referred to simply as ink).

2. Related Background Art

In recent years, there have been on the market as ink jet recording apparatuses, monochromatic ink jet recording apparatuses capable of recording only in a single color, and those capable of recording in colors. In these ink jet recording apparatuses, a capping mechanism is provided for an ink jet recording head which may be left intact for a long period of time. Usually, a cap made of a resilient rubber material is arranged to be in contact with the head surface (the surface of orifices) under pressure to make an enclosed space for the head surface, which is shut from the atmosphere, thus preventing the orifices (discharge ports) from being clogged due to drying of ink.

There are also in practical use the ink Jet recording apparatuses having an ink suction device and ink compression device together with a head recovery function in order to maintain among others the stabilized discharge of ink jet head or improve the defective discharging condition thereof by utilization of the capping mechanism. The typical structure of a recovery apparatus having a suction device is shown in FIG. 34 and FIG. 35, for example. As shown in these figures, a resilient cap 228 is arranged to advance to or retract from the recording head 232 of a scanning type when the head is in the home position. There are provided a capping mechanism which allows the cap 228 to abut on the recording head when it advances, and keep the space formed by the cap 228 and the recording head 232 in a state of being shut from the atmosphere, and a source 229 for manually generating a negative pressure, which is connected to this cap 228 through a tube 230 serving as a connecting member. Also, a pumping mechanism is provided for sucking ink from the recording head 232 by actuating the source 229 for manually generating negative pressure through the cap 228 which is in contact closely with the recording head under pressure, as well as for sucking ink from the interior of the cap by actuating the source 229 for manually generating negative pressure through the cap 228 when the cap is in a state of being released to the atmosphere. In this respect, it is needless to mention that the source 229 for manually generating negative pressure can be arranged as a source of an automatic type for generating negative pressure.

Here, the recording head 232 is kept airtight by the capping which is provided by the cap 228 while the recording head disengages from printing. Thus the discharge ports of the recording head can be prevented from being dried, and also, from adhesion of dust particles and others in the air outside. In this way, the stabilized discharge is executable. Meanwhile, however, the usual discharge may become inexecutable, that is, a case where a defective ink discharge may ensue, due to some causes, such as the generation of bubbles in the ink passages in the interior of the recording head, adhesion of dust particles to the ink discharge ports, or the ink which becomes overly viscous. Therefore, in order to recover the discharge capability of the recording head for the execution of the stabilized discharge, the above-mentioned pumping mechanism is actuated while the recording head 232 is capped by the cap 228 so that the head is in the airtight condition, and then, ink is sucked from the ink discharge ports of the recording head.

On the other hand, fine liquid particles such as ink mist, which are generated at the time of ink discharging, adhere to the surface of the recording head (orifice surface). This may also disturb the usual ink discharge in some cases. Therefore, after the completion of a given recording, a cleaning blade is used for a contact cleaning of the surface of the recording head. In either case described above, the conventional capping mechanism and cleaning mechanism are of the type that directly works on the ink jet recording head.

While these conventional capping and cleaning mechanisms are recognized to be effective in attaining the stabilized discharge of the recording head 232 in a long-term view, the inventor hereof has come to notice a problem yet to be solved in this respect. In other words, no one has given any attention to the condition of the surface of the cap on the recording head side at all, but the inventor hereof has found that firmly fixed ink, dust particles, paper fluffs, and others are accumulated on the surface of the cap on the recording head side, and that such accumulation, if exists, leads to an imperfect airtightness provided by the cap 228 for the recording head. Thus the capping effect is not good enough for the head which is on standby, causing the discharge ports to be dried, and also, creating the overly viscous ink. The discharging condition of the recording head becomes unstable inevitably or it requires more time to recover the recording head, thus wastefully using more ink for its recovery. This state is represented in FIG. 34 and FIG. 35. Here, with reference to FIG. 34 and FIG. 35, the description will be made of the present invention in detail with a view to solving the new problem thus found.

As shown in FIG. 34, if dust particles and paper fluffs 231 adhere to the portion where the cap 228 abuts on the recording head 232 (the surface of the cap on the recording head side), a space 233 is created in the vicinity of the inclusion 231 such as dust particles or paper fluffs existing between the cap 228 and recording head 232. As a result, the airtightness to be maintained between the cap 228 and recording head 232 cannot be obtained by capping, thus making it impossible to prevent the recording head from being dried. Also, it becomes impossible to carry out a sufficient suction for the recovery of the recording head or avoid ink leakage when exerting compression to recover the recording head. Consequently, in some cases, the surface of the recording head is more stained instead of being cleaned. Particularly, in executing the suction recovery, although the suction can be made to a certain extent immediately after the actuation of sucking, but the air outside is also sucked in when the suction is continued. Therefore, in some cases, the condition is forced to change so much as to make the suction from the interior of the recording head inexecutable at all. In order to improve this situation, it is attempted to increase the number of cleaning operations, with the result that no essential effects are produced on improvement.

To solve the new problem by the present invention will not only result in a more reliable capping for the recording head, but also result in the elimination of the wasteful use of time and ink for the recovery required. Therefore, the solution of this problem is extremely significant in view of the provision of a more reliable ink jet technique. Further, the present invention contributes to obtaining a more stability in the ink discharge of an ink jet recording head. It is also an object of the present invention to provide a more rationalized capping structure with a view to solving the drawback of the cap as described above.

The technical aspect of the present invention is equally applicable to the cap to be used for an ink jet head of a full-line type. Here, since a cap which is integrally formed by a plurality of capping units for a head unit having two to four ink jet heads tends to create uneven distribution of pressure to the head surface than those caps which are individually arranged to operate for such a head unit, the possibility is that each of the heads is more easily affected by the above-mentioned problem. From this point of view, the solution of the problem becomes more important.

Now, in a case of a monochromatic ink jet recording apparatus, black ink is most often used as an ink color for recording. Red, Green, and Blue are also used as required. However, since the structure is such that only one cartridge can be mounted on the carriage, a cartridge for black ink is mounted for recording in black, and if a recording is to be made in red, another cartridge for red ink should be mounted after the cartridge for black ink is removed from the carriage. Also, since only one cartridge is mountable on the carriage, only one cap is provided.

On the other hand, in a case of a full-color ink jet recording apparatus, four cartridge each for yellow, cyan, magenta, and black are usually mounted on a carriage, and caps are also arranged for each of the colors. For each of the recording heads, its discharge surface is airtightly closed by each capping, and then, should any defective discharge take place, ink is sucked from the discharge ports through the cap. In order to suck ink from each of the recording heads, it is necessary to connect each cap with the pumping mechanism per color. The resultant structure becomes inevitably complicated. Therefore, a structure is proposed, wherein the capping is carried out by only one head for all the recording heads. In this case, if a desired color ink must be sucked from the corresponding head, the carriage should be moved so that the target recording head is positioned in front of the cap for suction because there is only one cap arranged. As a result, if the recording heads are four, the positions for the carriage to suck ink should also be four. Also, there is proposed a structure wherein, besides a cap for sucking ink from the discharge ports, protective caps are arranged for each of the recording heads, which do not suck ink from them but just cover them closely.

Also, irrespective of a monochrome or full colors, a wiper is often provided for the recovery unit in order to remove foreign particles adhering to the recording head and cap. Further, the discharge port surface of a recording head is capped to maintain the airtightness when the recording head disengages from recording, hence implementing the stabilized discharge by preventing the discharge ports from being dried and also, from the adhesion of any foreign particles.

Nevertheless, in the conventional ink jet recording apparatuses described above, only one suction cap is arranged for heads for recording in plural colors. Therefore, a problem is encountered in that if a recording head for red ink is used after having used a recording head for black ink, for example, the recording in red becomes blackish due to the mixture of the black ink.

More specifically, when the recording head for black ink is being used, the discharge port surface of the recording head, that is, the surface to be capped is stained with black ink due to the ink suction, the ink wiping operation by wiper, and the flight of ink when ink is discharged from the discharge ports. In such a state, the recording head is again capped when it disengages from recording in order to prevent the discharge ports from being dried, and also, from the adhesion of any foreign particles thereto. As a result, black ink adheres to the surface of the cap which abuts on the discharge port surface (hereinafter, this surface of the cap is referred to as "sealing surface").

Subsequently, if, for example, the recording head for black ink is replaced with the recording head for red ink for recording, the black ink which has adhered to the sealing surface of the cap adheres to the discharge port surface of the recording head for red ink. When a wiping is performed in this state in order to remove foreign particles, the black ink adhering to the discharge port surface of the recording head for red ink is pressed into the interior of the discharge ports thereof. As a result, red ink and black ink are mixed. Also, even if no wiping is performed, the possibility is that the black ink adhering to the discharge port surface flows into the discharge ports at the time of recording or capping.

Here, regarding the color mixing due to the ink of different color which is pressed into the discharge ports by wiping operation, it is possible to prevent the mixed ink from being discharged by conducting a predischarge onto a place other than the recording area, the interior of the cap, for example, immediately after the wiping operation. However, when the ink adhering to the discharge port surface flows into the discharge ports to create a color mixing, it is extremely difficult to prevent it from taking place because the timing of the ink flowing into it can hardly be specified.

SUMMARY OF THE INVENTION

The present invention is designed in accordance with the knowledge that the inventor hereof has acquired by giving attention to the problems as described above, as well as with a view to solving such problems after having assiduously studied them. It is an object of the invention to provide an ink jet apparatus capable of reliably executing a recovery process by preventing the airtightness created by the cap from becoming imperfect for the discharge ports due to foreign particles adhering to the surface of the cap on the head side, and also, to provide a recovery mechanism for such an ink jet apparatus.

According to the present invention, it is possible to provide a recovery mechanism for an ink jet apparatus comprising a cap for capping the discharge ports of the ink jet head, wherein means for cleaning the surface of the cap on the head side is provided.

Also, according to the present invention, it is possible to provide a recovery mechanism for an ink jet apparatus comprising a cap for capping the discharge ports of the ink jet head, wherein means for cleaning the surface of the cap on the head side is provided together with means for sucking the interior of the cap subsequent to having cleaned the surface of the cap on the head side by use of the cleaning means.

Also, according to the present invention, it is possible to provide an ink jet apparatus comprising an ink jet head, and a cap for capping the discharge ports of the ink jet head, wherein means for cleaning the surface of the cap on the head side is provided.

In this respect, "means for cleaning the surface of the cap on the head side" includes all the structures which make it possible to clean by contact or indirectly (or by combination of the two) the area in which the cap abuts on the ink jet head. Specifically, among some others, means for blade cleaning, means for giving a compressed gas or water vapor, water, or other liquid to the area where the cap abuts on the ink jet head are included as referred to in the embodiments given below. Any other means than those mentioned above may be included if only such means can produce a cleaning effect. From the viewpoint of effectiveness, however, it is most suitable to use a wiping blade as cleaning means.

It is possible for the present invention to make its effect more reliable by arranging the ink jet apparatus so that the apparatus has control means for executing a step of cleaning the surface of the cap on the head side by use of the cleaning means before the step of capping the ink jet head by use of the cap. As an invention having an additional objective to secure a long term stability for the intended effect of the invention, it is preferable to arrange its structure so that there are provided a blade for cleaning the surface of the cap on the head side as the cleaning means, and means for cleaning the blade to clean the surface of the cap on the head side. In this way, the capability of the blade for cleaning the cap can be maintained for a long period of time. Particularly, as an ink jet apparatus, the provision of these means is advantageous because with this provision, it becomes possible to give a long interval between the replacements of the blades for cleaning the cap.

Also, in order to make the effect of the present invention easily adaptable to the surrounding environment, it is preferable to employ a structure whereby to clean the surface of the cap on the head side while the blade for cleaning the surface of the cleaning on the head side, serving as cleaning means, is being shifted from the upper to the lower side. In this way, the dirt cleaned off by the blade for cleaning the surface of the head side can drop downward. This is advantageous than flying the dirt off upward because it can avoid staining the surroundings. Particularly, it is preferable to actuate the means for cleaning the blade to clean the surface on the head side to operate while the blade for cleaning the surface on the head side is in the process of shifting from the upper to the lower side because this blade can be cleaned more efficiently in such a way.

In order to achieve the object of the present invention completely in a better condition, it is desirable to consider the surface of the head itself. Therefore, the capping mechanism for an ink jet head should preferably comprise cleaning means having the blade for cleaning the surface of the cap on the head side as well as means for cleaning the surface of head by use of a blade which is interlocked with the blade for cleaning the surface of the cap on the head side. Here, the concept of "interlocking" includes a case where the respective executions of cleaning can be divided into those before and after capping or a case where both of them may be executed in the preprocess or post process of the capping. As an ink jet apparatus, all of the apparatuses are included if only the capping state can be materialized in the respective apparatuses on the cleaned surface of the head by the application of each cleaning and use of the cleaned cap.

Further, it is an object of the present invention to provide a capping mechanism for an ink jet head, which comprises a cap for capping the head by causing it to contact the ink jet head; means for cleaning the surface of the cap on the head side; and means for sucking the interior of the cap after the surface of the cap on the head side is cleaned by the cleaning means. With this structure, the dirt cleaned off from the surface of the cap on the head side can be collected inwardly to the interior of the cap. Thus it is possible to prevent the dirt from being transferred to the surface of the head more efficiently when capping the head. If the passage for collecting ink has a small diameter, the fluffy particles cause clogging in some cases. It is, therefore, preferable to provide a porous element such as a sponge or a filter in the cap.

In this respect, while it is preferable to arrange a structure so that the blade for cleaning the surface of the cap on the head side, and the blade for cleaning the head itself can be provided separately. In order to simplify the structure, the blades can be one and the same or the cleaning portion of the cap and the head can be positioned differently for one and the same blade. A structure of the kind is also included in the present invention.

Further, according to an ink jet recording apparatus of the present invention, ink in the discharge ports of the recording head is sucked by suction means after the discharge port surface of the recording head is airtightly closed by the cap. When the ink thus sucked adheres to the surface where the cap abuts on the discharge port surface, an ink absorbent moves to the position facing the cap. In this state, the cap shifts toward the discharge port surface. Then the surface of the cap abuts on the ink absorbent. In this way the ink adhering to the abutting surface of the cap is absorbed into the ink absorbent, hence making it possible to avoid the adhesion of ink in a color to the discharge port surface of the head which has been used for recording in another color even if the recording head is airtightly closed by only one cap. As a result, ink of different colors are prevented from being mixed when ink is discharged.

Also, if the ink absorbent can be arranged to be shiftable in the moving direction of the cap while the ink absorbent is in the position facing the cap, the other face of the ink absorbent abuts on the discharge port surface of the recording head along the movement of the cap toward the discharge port surface. As a result, ink adhering to the discharge port surface can be absorbed together with ink adhering to the cap. In this way, it is possible to remove the ink adhering to the cap from the discharge port surface of the recording head when the discharge port surface is again closed airtightly by the cap. This arrangement makes the prevention of the color mixing more effective.

Further, when a recording is mounted on a reciprocating carriage, it is possible to simplify the shifting mechanism and mounting mechanism for the ink absorbent by making an arrangement so that the ink absorbent can be mounted on the carriage.

In addition, with the provision of a second ink absorbent which is mountable on a cap holder, it is possible to absorb ink adhering to the discharge port surface together with ink adhering to the cap even if the ink absorbent should be mounted on the carriage.

DETAILED DESCRIPTION OF THE PREFERRED EMBODIMENTS

The embodiments given below describe means for cleaning the surface of a cap on the head side as a blade wiping structure which is typical of the structures according to the present invention, but it is to be understood that such means includes all the structures wherein the area of an ink jet head on which the cap abuts is cleaned by contact or indirectly (or by a combination of the two). More specifically, the cleaning means includes among others means for giving the air, compressed gas, or water vapor, water, or some other liquid to the area of the ink jet head on which the cap abuts, and it is needless to mention that any other means than those named that may produce a cleaning effect are also included. Hereinafter, with reference to the accompanying drawings, the present invention will be described specifically.

Figure 1:
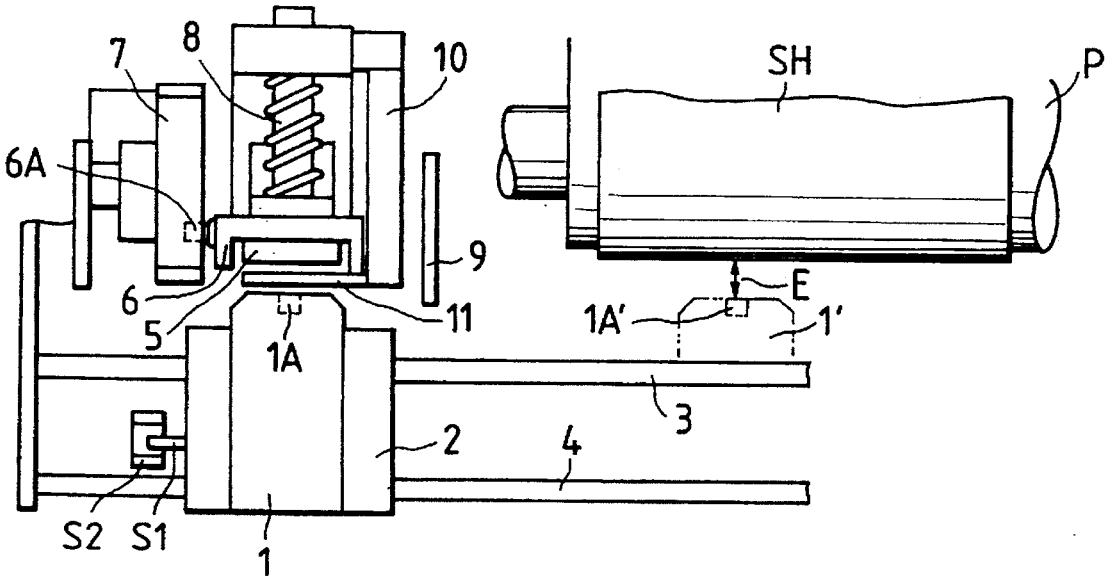
FIG. 1 is a view schematically showing the principal part of an ink jet recording apparatus according to a first embodiment of the present invention.

FIG. 1 illustrates an embodiment of an ink jet apparatus according to the present invention. In FIG. 1, an ink jet recording head 1 is mounted on a carriage 2. The carriage 2 is guided by guide shafts 3 and 4 to enable the recording head 1 to reciprocate with a given space E for recording between a recording area (the area indicated by broken line for the recording head 1') and the home position of the recording head 1, which is indicated by solid line in FIG. 1, with respect to a sheet SH which is guided along a platen roller P. The carriage 2 travels by driving means (not shown) comprising a carriage motor, a driving pulley connected to this motor, a timing belt tensioned around this driving pulley, and others. The reciprocating drive is possible by changing the rotational direction of the carriage motor.

On the carriage, an extrusion S1 is installed to interfere with the photosensor S2 fixed to the main body of the apparatus in a position for detecting the home position. When the photosensor S2 is interrupted by the extrusion S1, the home position is detected. Then, the carriage motor is suspended. In this way, the recording head 1 and the carriage 2 are suspended at the home position. On the front surface (discharge port surface) 1A of the recording head 1, many numbers of discharge ports are formed. Also, a head unit is integrally formed with the front surface. This head unit comprises an ink tank containing ink as a recording agent, and ink jet elements (preferably, electrothermal transducers for generating film boiling), having a function to discharge ink and arranged in each of the ink passages provided for the corresponding discharge port, respectively.

Figure 33:
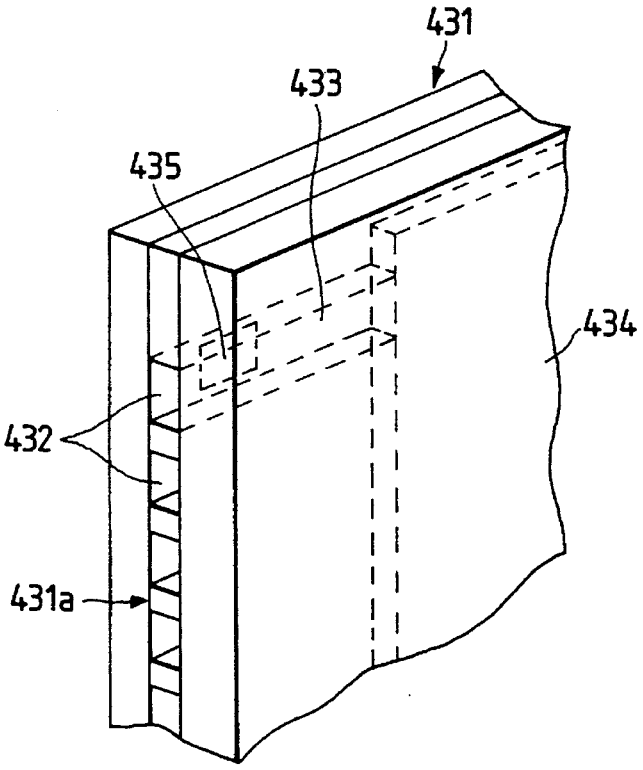
FIG. 33 is a perspective view schematically showing an example of the ink jet head element.
Figure 34:
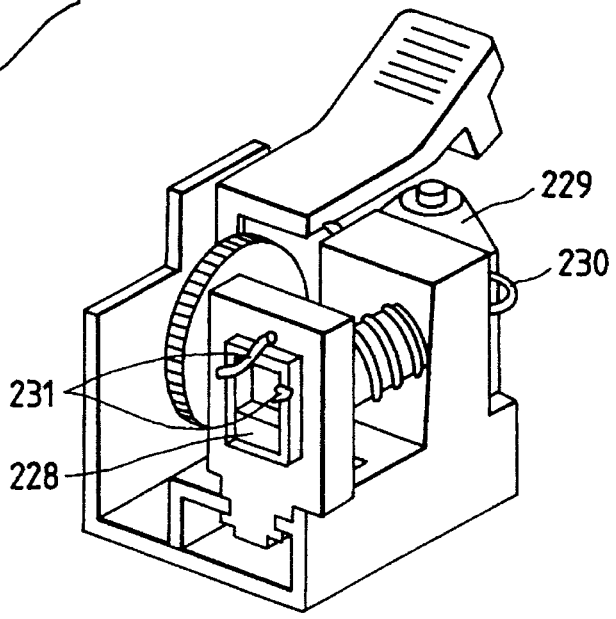
FIG. 34 is a perspective view schematically showing a recovery mechanism for the conventional ink jet recording apparatus.
Figure 35:
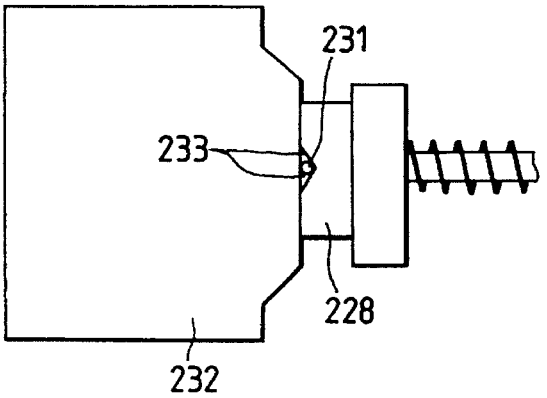
FIG. 35 is a side view schematically showing the recovery mechanism for the conventional ink jet recording apparatus.

Here, with reference to FIG. 33, the head element 431 will be described. On the discharge port surface 431*a* of the head element 431, which faces a recording material SH with a given space (see FIG. 1), a plurality of discharge ports 432 are formed at given pitches. Electrothermal transducers (heat generating resistors and others) 435 for generating energy to discharge ink are arranged along each of the walls of liquid passages 433 which conductively connect a common liquid chamber 434 and each of the discharge ports 432. The common liquid chamber 434 is conductively connected to the ink tank. The common liquid chamber 434 is structured so that ink is supplied from the ink tank. The ink which is supplied to the common liquid chamber 434 and temporarily retained in it enters the liquid passages 433 by the capillary phenomenon to form meniscus at the discharge ports 432, thus creating a state where the liquid passages 433 are filled with ink. At this juncture, when the electrothermal transducers 435 are energized through electrodes (not shown), ink on the respective electrothermal transducers 435 are heated abruptly, hence creating air bubbles in the liquid passages 433. By the expansion of the air bubbles, ink is discharged from the discharge ports 432. In this respect, the electrothermal transducers 435 are shown as the elements to generate energy. The present invention is not limited thereto, but it may be possible to use the piezoelectric elements which generate energy mechanically to exert instantaneous pressure for discharging.

Again reverting to FIG. 1, a cap 5 is to airtightly close the recording head 1. The cap is made of a butyl rubber or some other appropriately resilient material. A reference numeral 6 designates a cap holder to enclose the cap 5; 7, a gear connected to and driven by a motor (the aforesaid carriage motor may be applicable); and 8, a spring which is biased to press the cap holder 6 and the cap 5 forward. On the inner wall of the gear 7, a cam 7A (not shown) is arranged so that an extrusion 6A provided for the cap holder 6 abuts on and moves along the cam. When the gear 7 rotates by means of the aforesaid motor (not shown), the extrusion 6A provided for the cap holder 6 moves along the cam 7A to allow the cap holder 6 which encloses the cap 5 to move forward and backward. In this way, the cap 5 is caused to abut on or retract from the recording head 1 mounted on the carriage 2. Here, when the cap 5 is in contact closely with the recording head 1 in the home position, the discharge ports of the recording head 1 are airtightly closed against the air outside.

A reference numeral 9 designates a wiper for the recording head, which is arranged in a position indicated in FIG. 1 between the recording area and the capping mechanism. The wiper is controlled in such an overlapping amount that when the carriage 2 moves and passes in front of the wiper 9, the discharge port surface 1A of the recording head 1 can be wiped. The wiper 9 is a flexible rubber blade, and is made of an appropriate material such as urethane rubber or silicon rubber. Therefore, the discharge ports 1A of the recording head 1 is wiped when the carriage returns to the home position (capping position) periodically. No paper fluffs nor dust particles adhere to the ink discharge ports 1A. These are not accumulated on it, either.

A reference numeral 10 designates a cap wiper lever which is driven by a motor (not shown—the aforesaid carriage motor may be applicable) to rotate as shown in FIG. 2 to FIG. 6 by means of a cam (not shown). A cap wiper 11 is mounted on the leading end of the cap wiper lever 10 for wiping and cleaning the surface of the cap on the head side. The cap wiper 11 is a flexible rubber blade and is made of an appropriate material such as urethan rubber or silicon rubber.

Figure 2:
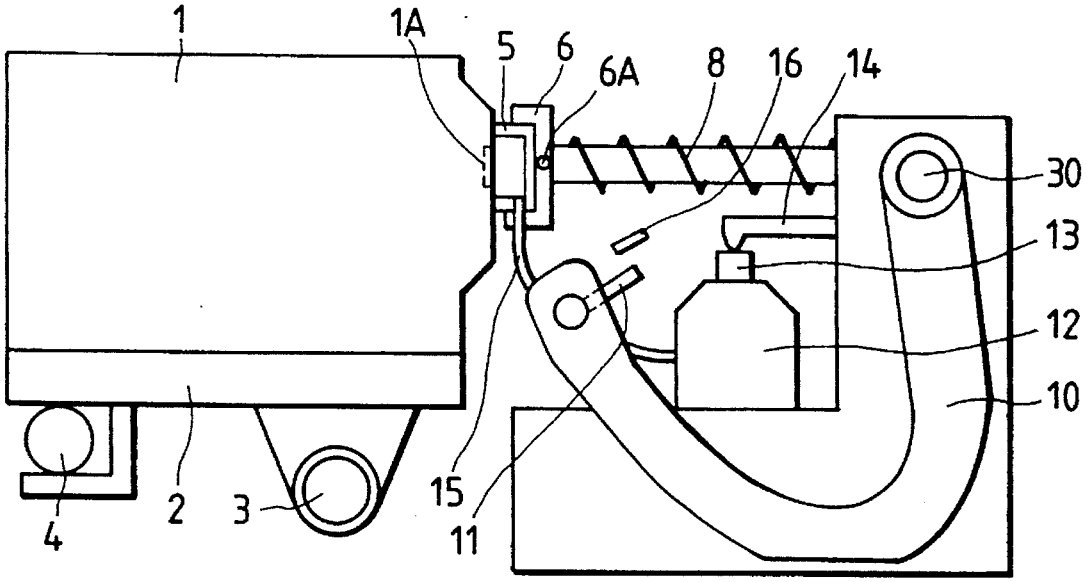
FIG. 2 is a side view showing the state of capping according to the first embodiment of the present invention.
Figure 3:
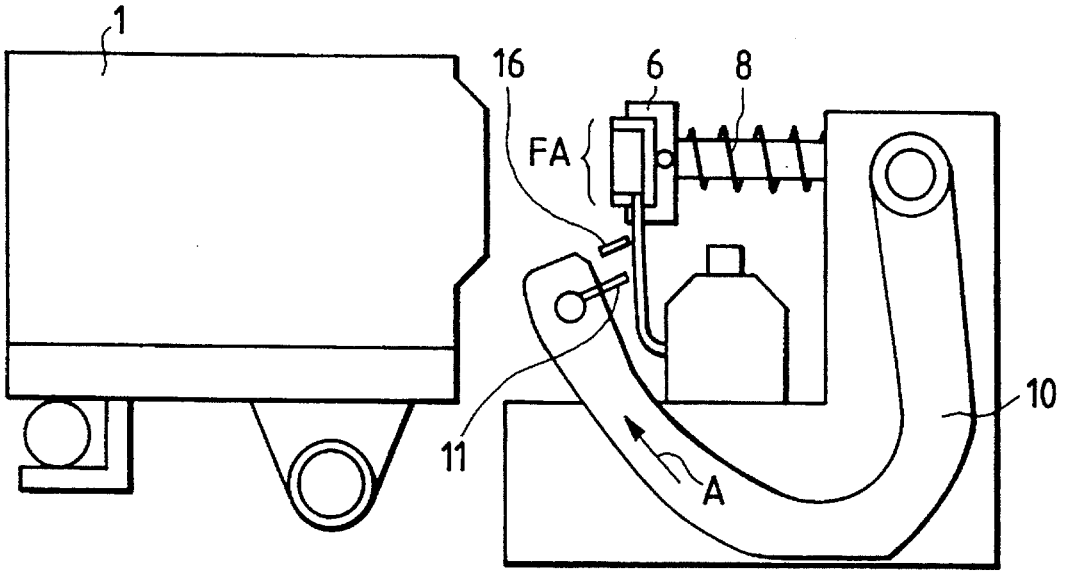
FIG. 3 is a side view showing the state of starting the cleaning of the cap according to the first embodiment of the present invention.

Here, in conjunction with FIG. 2 to FIG. 6, the specific operation of the cap wiper 11 will be described in detail. FIG. 2 is a view showing the recording head 1 which is capped by the cap 5 in the home position. A reference numeral 12 designates a pump, a source for generating a negative pressure. The negative pressure is generated when a piston 13 is depressed downward by means of the pump lever 14, thus making it possible to such ink from the ink discharge ports 1A through a tube 15 and the cap 5. The cap wiper lever 10 can move rotatively around a shaft 30 by means a cam (not shown). Here, when a signal is transmitted from a central controller CPU (not shown) to execute a cap wiping, the gear 7 shown in FIG. 1 rotates. Thus the cap holder 6 retracts while compressing the spring 8 (see FIG. 3).

Figure 4:
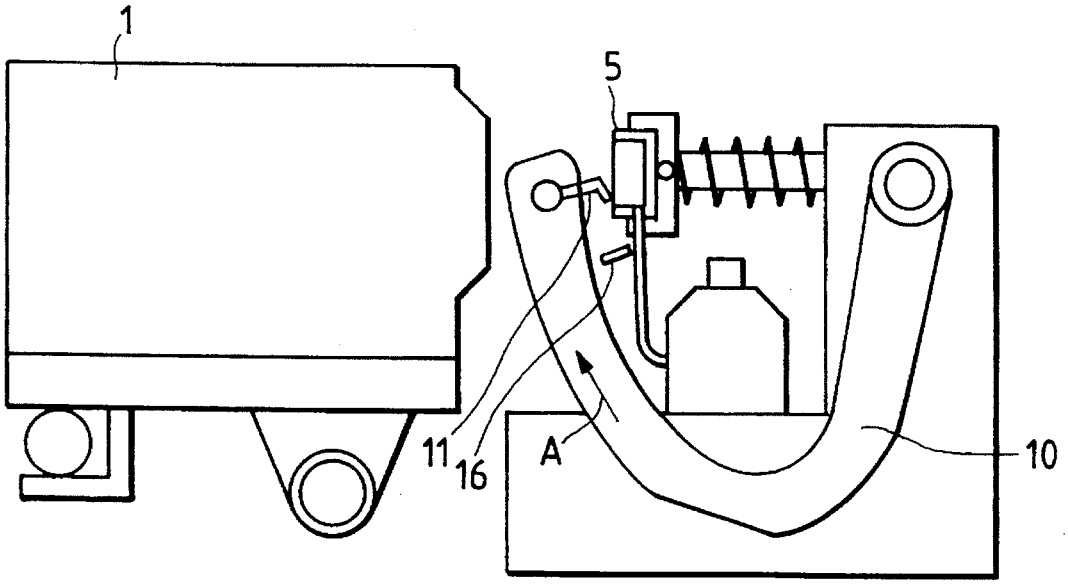
FIG. 4 is a side view showing the state of cleaning the cap according to the first embodiment of the present invention.
Figure 5:
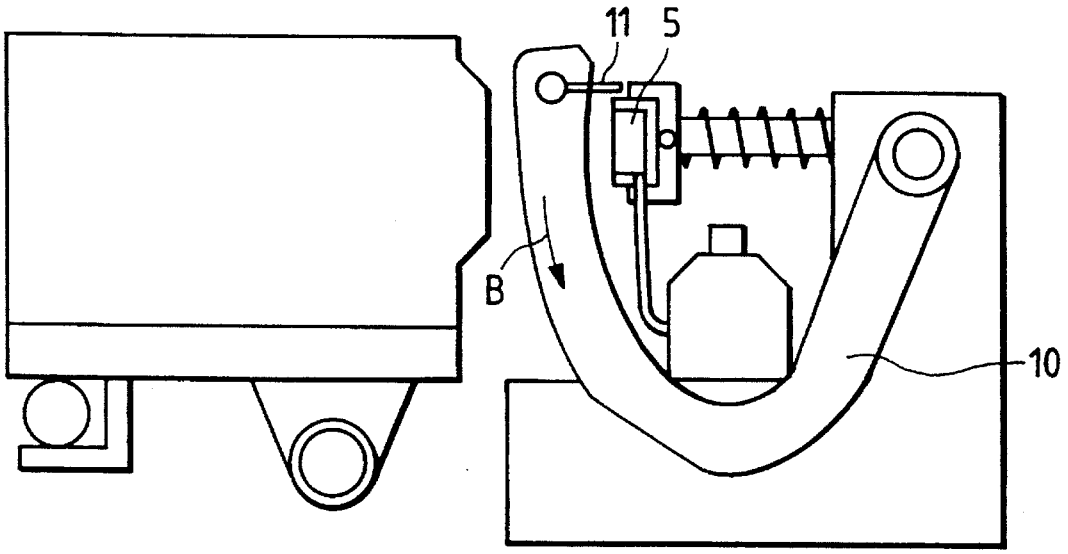
FIG. 5 is a side view showing the state of starting again the cleaning of the cap according to the first embodiment of the present invention.
Figure 6:
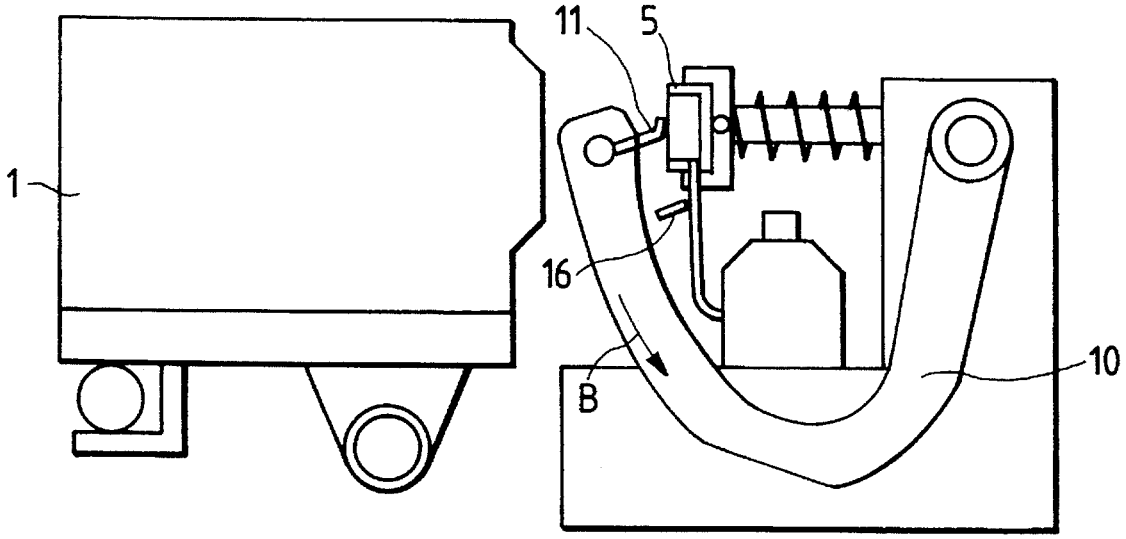
FIG. 6 is a side view showing the state of again cleaning the cap according to the first embodiment of the present invention.

Subsequently, the cap wiper lever 10 starts to rotate by means of a cam (not shown) in the direction indicated by an arrow A. At first, dust particles and others adhering to the cap wiper 11 is scraped off by the blade 16 serving as means for cleaning the cap wiper, and then, the cap wiper ascends toward the top of the cap. At this juncture, as shown in FIG. 4, the cap wiper 11 wipes from the down to the upper side the portion of the cap 5 which abuts on the recording head 1 (the surface of the cap on the head side FA: see FIG. 3) while ascending. Then the surface of the cap on the recording head side is recovered to a good cleaned condition because the paper fluffs, dust particles, and others adhering thereto are all removed by the cap wiper 11.

Further, in the present embodiment, a structure is adopted to wipe the surface of the cap on the recording head side when the cap wiper lever 10 descends. This arrangement enhances the cleaning effect. In other words, the lever further rotates in the direction indicated by the arrow A so that the cap wiper 11 arrives at the upper point of the cap. Then the rotation of the cap wiper lever 10 is suspended (see FIG. 5). Subsequently, the cap wiper lever 10 is reversely rotated in the direction indicated by an arrow B by reversing the rotation of the cam (not shown) which moves the cap wiper lever 10. Therefore, the cap wiper 11 descends while wiping from the upper to the lower side the portion of the cap 5 which abuts on the recording head (the surface of the cap on the recording head side) FA (see FIG. 6). Then the surface of the cap on the recording head side is recovered in a better and more reliably cleaned condition because any paper fluffs, dust particles, and others which still remain adhering to the surface are removed by the cap wiper 11.

In the present embodiment, the structure is arranged in such a manner that subsequent to the step of cleaning the cap, the cap wiper 11 having scraped off the dust particles and other adhesives is cleaned by the blade 16. Therefore, the cap wiper 11 can be immediately recovered to a state best suited for wiping. In other words, when the cap wiper lever further rotates in the direction indicated by the arrow B, the dust particle and others adhering to the cap wiper 11 are again removed by the blade 16. Then, when the cap wiper lever 10 returns to a given position, the cap holder 6 advances so that the recording head 1 is capped by the cap 5 (see FIG. 2).

In this respect, the "wiping of the surface of the cap on the recording head side FA", which constitutes a feature of the present embodiment according to the present invention, may be executable while the recording head is in the recording area (in printing or on standby), not necessarily when the recording head is in the home position or the carriage is in the home position as described in the above-mentioned embodiment. By the operation as described above, the surface of the cap on which the recording head abuts (sealing surface) is wiped, hence making it possible to remove the paper fluffs, dust particles, and others adhering to the cap. Therefore, the airtightness of the recording head can be secured at all times when capped. Particularly, when a structure is adopted so that the drying of the ink discharge ports of the recording head is prevented, and at the same time, the suction is carried out in the state of the head being capped, the suction of ink from the discharge ports can be carried out more reliably for the recovery of the recording head.

Figure 7A:
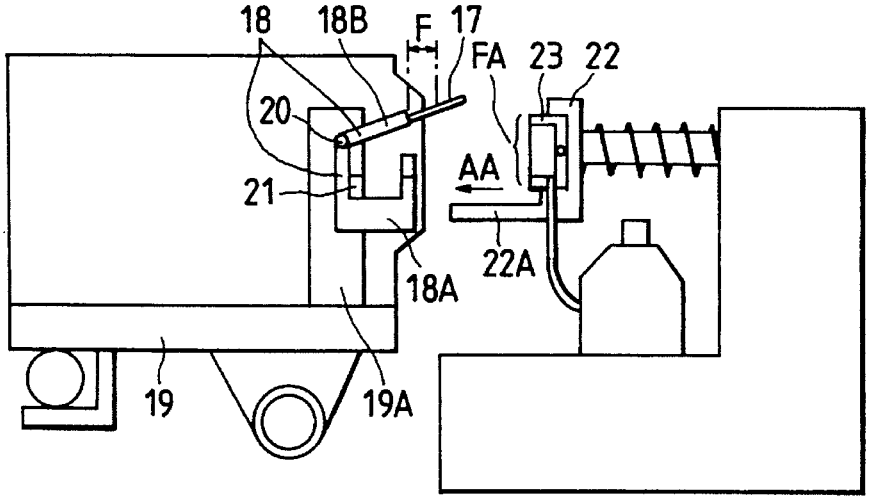
FIGS. 7A and 7B are side views showing the state of starting the cleaning of the cap according to a second embodiment of the present invention.
Figure 7B:
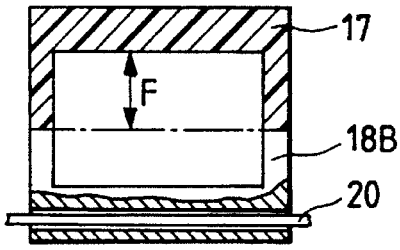
Figure 8:
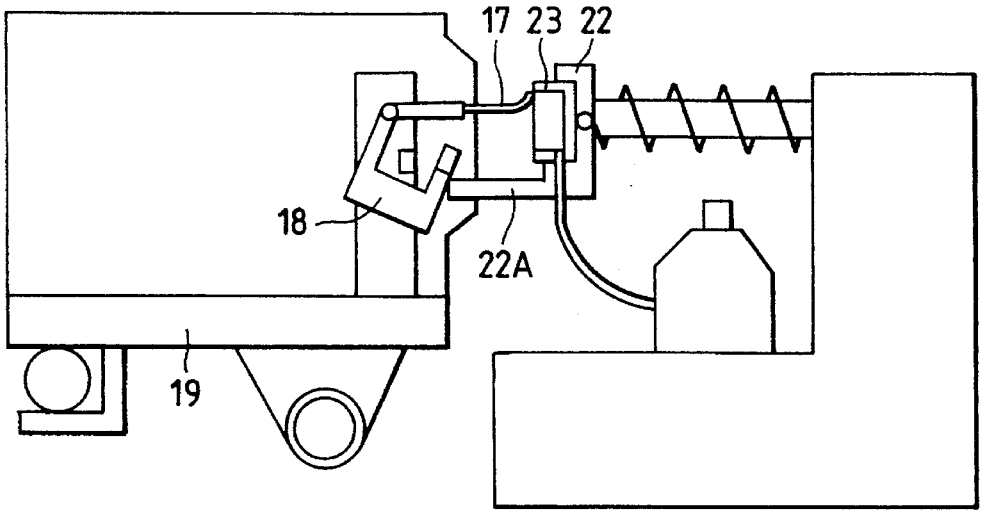
FIG. 8 is a side view showing the state of cleaning the cap according to the second embodiment of the present invention.

FIGS. 7A and 7B, and FIG. 8 are views showing a second embodiment according to the present invention. In the present embodiment, means for cleaning the cap according to the present invention is mounted on the carriage. Unlike the previous embodiment, therefore, the surface of the cap on the recording head side FA is wiped only when this cleaning means faces the cap. In this respect, the description will be omitted for any structures that may be shared by the previous embodiment.

In FIGS. 7A and 7B, and FIG. 8, a reference numeral 17 designates a cap wiper. This wiper is mounted on the leading end of the wiper supporting portion of the cap wiper lever 18 for which the wiper supporting portion 18B having a portion 18A in the U-letter form positioned on both sides of the head, and the wiper supporting portion 18B having an aperture are integrated at an angle shown in FIG. 7B. In order to allow the head prtion of the ink jet recording head mounted on the carriage to pass, this cap wiper 17 comprises an aperture having a length F extended to the aperture of the wiper supporting portion 18B, and a blade portion having a width which can clean the surface of the cap 23 on the recording head side FA entirely as shown in FIG. 7B.

The cap wiper lever 18 is rotatively supported around the shaft 20 of a supporting pole 19A provided for the carriage 19. In this respect, the wiper lever 18 is biased by means of a twisted coil spring (not shown) so that it can be in the state shown in FIG. 7A. By the stopper 21 arranged for the supporting pole 19A, the upper limit of its movement is regulated. As a result, unless an external force is exerted, the rotation of the cap wiper lever 18 is suspended in the position indicated in FIG. 7A. The portion 18A in the U-letter form has the extruded parts which are set vertically in a state shown in FIG. 7A so that the external force is received at the leading ends, and as the cap holder 22 advances, this portion transforms the external force exerted by the advancing extrusion 22A into the rotational force in order to rotate the entire body of the wiper lever clockwise.

Here, when a signal for cap wiping is transmitted form the central controller of the apparatus CPU (not shown), the carriage 19 returns to the home position. The cap holder 22 advances in the direction indicated by an arrow AA. Then the extrusion 22A provided for the cap holder 22 pushes the extrusion of the cap wiper lever 18. The cap wiper lever 18 starts to rotate around the shaft 20. The cap wiper 17 wipes the advancing cap 23 (see FIG. 8). Further, the cap holder 22 still advances, and the surface of the cap 23 on the recording head side is completely cleaned. Then, the cap wiper 17 moves downward from the space between the cap 23 and the recording head. Therefore, it does not interfere with the capping. In the present embodiment, the cap is cleaned without fail before the state of capping is formed, thus eliminating the drawbacks of capping completely.

When a signal for printing is received, and the capping is released, the cap holder 22 retracts. Along this retraction, the cap wiper lever 18 is caused to rotate counterclockwise by means of the twisted coil spring (not shown). In the present embodiment, too, the cap wiper 17 ascends while wiping the portion FA of the cap 23 which abuts on the recording head 1 from the lower to the upper side.

In the present embodiment, the wiping mechanism is arranged on the carriage as described above. Then the structure is arranged so that the wiping is driven by the cap holder which moves forward and backward. Compared to the previous embodiment, therefore, the cam and others are no longer needed for the wiping lever, thus reducing the part numbers, leading to the implementation of cost reduction. Also, the mechanism of the recovery system can be simplified, thereby to contribute to the enhancement of assembling operation. In this respect, the operational control of the cleaning mechanism on the carriage is carried out by the cap holder according to the present embodiment, but it is to be understood that the adoption of some other driving means and the movement of some other members for this control also fall under the category of the present embodiment.

Figure 9:
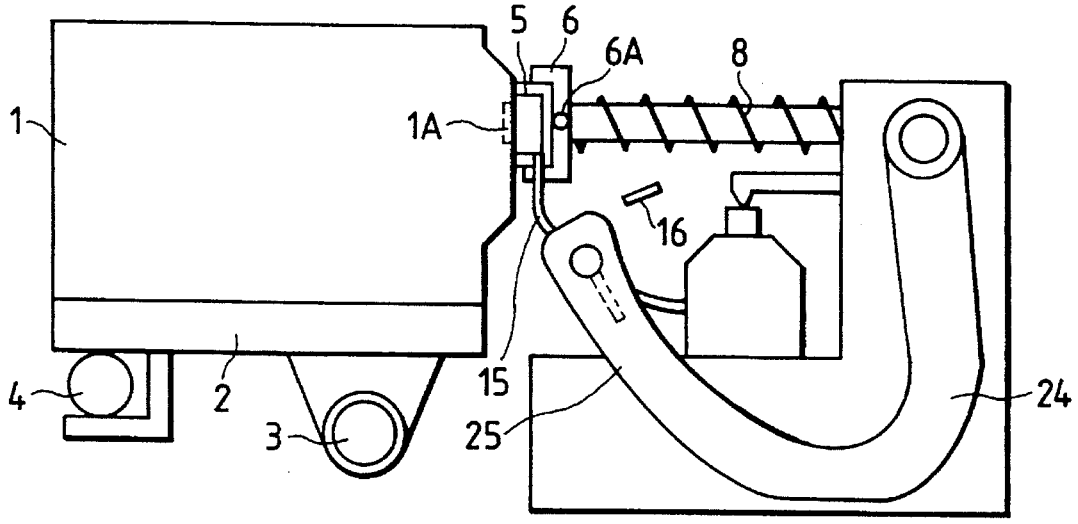
FIG. 9 is a side view showing the state of capping according to a third embodiment of the present invention.
Figure 10:
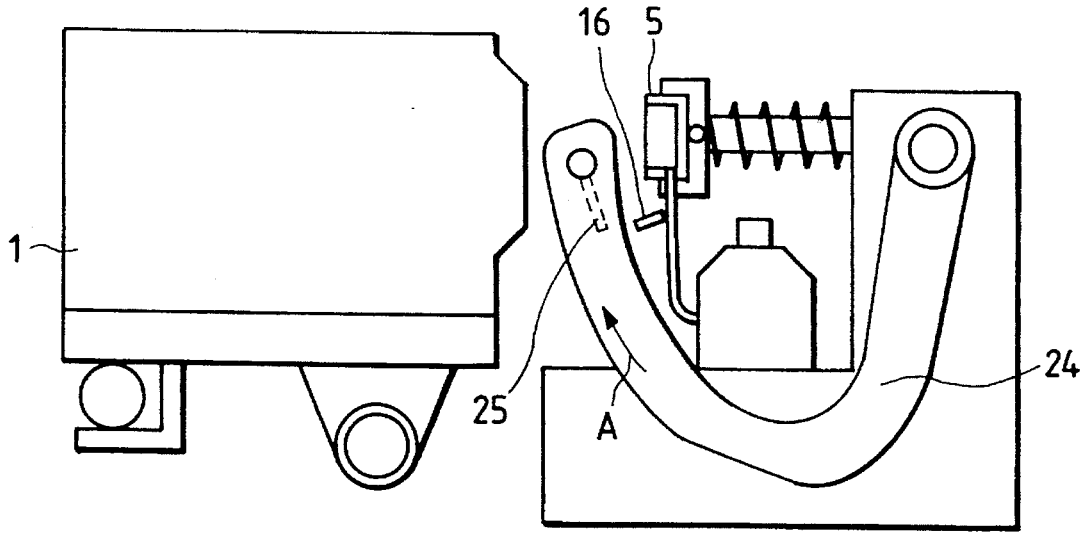
FIG. 10 is a side view showing the preparation stage for cleaning the cap according to the third embodiment of the present invention.
Figure 11:
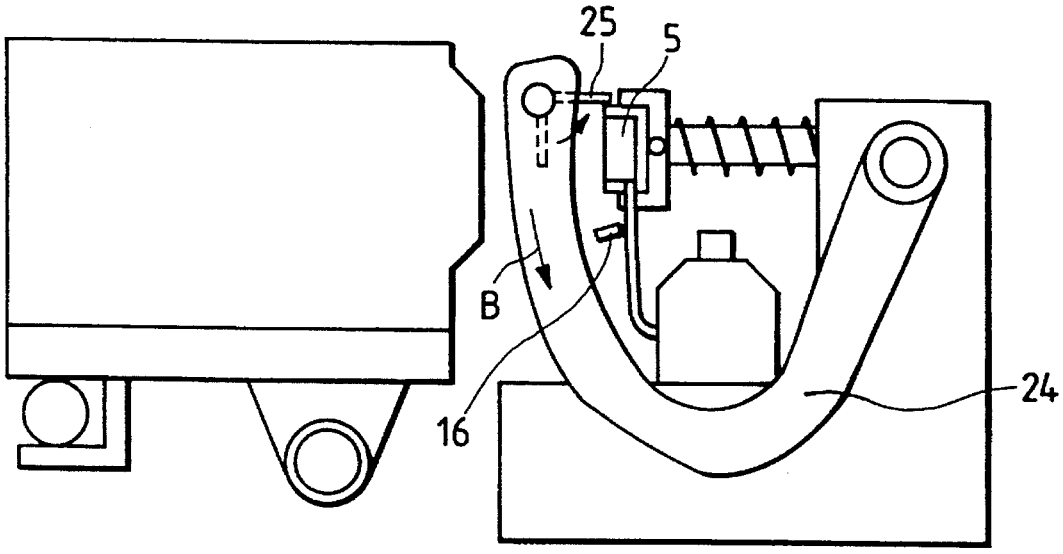
FIG. 11 is a side view showing the state of starting the cleaning of the cap according to the third embodiment of the present invention.

Now, FIG. 9 to FIG. 11 are views showing a third embodiment according to the present invention. In the present embodiment, what differs from the first and second embodiments in its structure is that the flight of the dust particles and ink is reduced at the time of cap cleaning by carrying it out only in one direction. Particularly, in the present embodiment, the cap cleaning is executed in the descending process from the upper to the lower side. Here, in the present embodiment, too, the description will be omitted for the structures that may be shared by the previous embodiments.

As shown in FIG. 9 to FIG. 11, when the cap wiper lever 24 is positioned below the cap 5, and the cap wiper lever 24 is being raised, the cap wiper 25 is housed in the cap wiper lever 24. Therefore, the cap 5 is not cleaned. In the present embodiment, the cap wiper 25 housed in the cap wiper lever 24 is made ready for cleaning in such a manner that the cap wiper 25 in the cap wiper lever is caused to extrude as shown in FIG. 11 by means of a wiper set lever, for example, which is triggered when the cap wiper lever has arrived at the upper dead point where the rotation of a cam for the movement of the cap wiper lever is reversed through driving means (not shown).

In this state, the cap wiper lever 24 rotates in the direction B, and then, the portion of the cap 5 which abuts on the recording head 1 (the surface of the cap on the recording head side) FA is wiped from the upper to the lower side. When the cap wiper lever 24 arrives at the lower dead point, the wiper set lever is reset so that the cap wiper 25 is again housed in the cap wiper lever 24. Subsequently, the recording head is capped by the cap 5. As in the present embodiment, the flight of dust particles and ink at the time of cap cleaning can be reduced significantly by restricting the cap cleaning only in one direction. Particularly, it is possible to more reliably prevent the dust particles and ink from flying to stain the inside and outside of the apparatus by conducting the cap cleaning in the descending process from the upper to the lower side.

As clear from the description of the embodiment 1 to embodiment 3, a resilient cap is in contact under pressure with the discharge port surface of the recording head in an ink jet recording apparatus, and then, a recovery device is equipped to suck ink by creating a negative pressure in the cap. In such an apparatus, it is now possible to remove the dust particles and paper fluffs adhering to the cap by the provision of the cap cleaning means as described above. Consequently, there is no leakage, thus always closing the recording head completely by the cap when capped.

Figure 12:
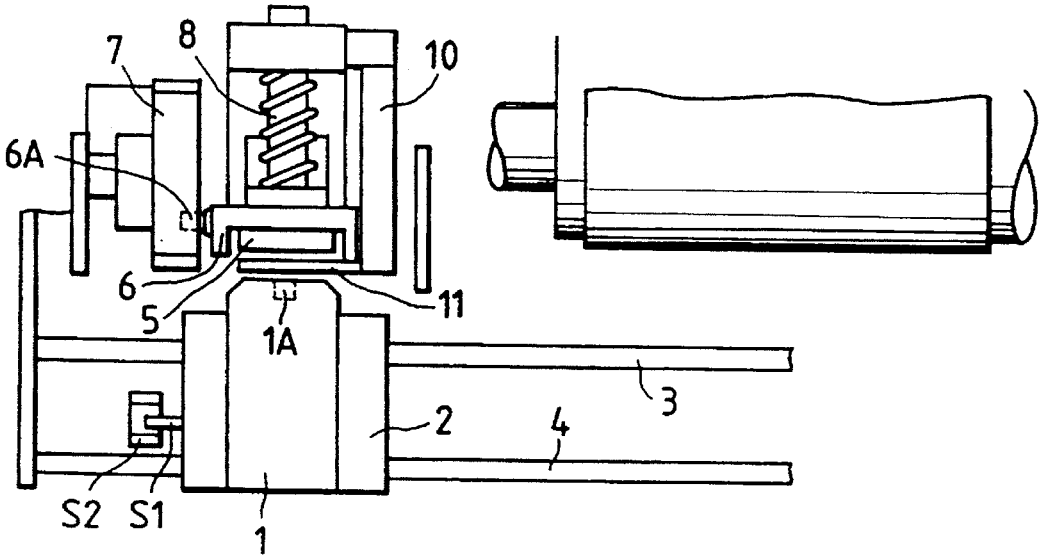
FIG. 12 is a view schematically showing the principal part of an ink jet recording apparatus according to a fourth embodiment of the present invention.

Now, in conjunction with FIG. 12 to FIG. 24, the description will be made of the embodiments in which means for cleaning cap according to the present invention is interlocked with means for cleaning the ink jet head. FIG. 12 is a view showing another embodiment of the ink jet recording apparatus according to the present invention. In FIG. 12, an ink jet recording head 1 is mounted on a carriage 2. The carriage 2 is guided by guide shafts 3 and 4 to enable the recording head 1 to reciprocate, with a given space E for recording, between a recording area (the area indicated by broken line for the recording head 1') and the home position of the recording head 1 indicated by solid line in FIG. 12 with respect to a sheet SH which is guided along a platen roller P.

The carriage 2 travels by driving means (not shown) comprising a carriage motor, a driving pulley connected to this motor, a timing belt tensioned around this driving pulley, and others. The reciprocating drive is possible by changing the rotational direction of the carriage motor. On the carriage, an extrusion S1 is installed to interfere with the photosensor S2 which is fixed to the main body of the apparatus in a position for detecting the home position. When the photosensor S2 is interrupted by the extrusion S1, the home position is detected. Then, the carriage motor is suspended. In this way, the recording head 1 and the carriage 2 are suspended at the home position.

On the front surface (discharge port surface) 1A of the recording head 1, many numbers of discharge ports are formed. Also, a head unit is integrally formed with the front surface. This head unit comprises an ink tank containing ink as a recording agent, and ink jet elements (preferably, electrothermal transducers for generating film boiling) having a function to discharge ink and arranged in each of the ink passages provided for the corresponding discharge port, respectively.

A cap 5 is to airtightly close the recording head 1. The cap is made of a butyl rubber or some other appropriately resilient material. A reference numeral 6 designates a cap holder to enclose the cap 5; 7, a gear connected to and driven by a motor (the aforesaid carriage motor may be applicable); and 8, a spring which is biased to press the cap holder 6 and the cap 5 forward. On the inner wall of the gear 7, a cam 7A (not shown) is arranged so that an extrusion 6A provided for the cap holder 6 abuts on and moves along the cam. When the gear 7 rotates by means of the aforesaid motor (not shown), the extrusion 6A provided for the cap holder 6 moves along the cam 7A to allow the cap holder 6 which encloses the cap 5 to move forward and backward. In this way, the cap 5 is caused to abut on or retract from the recording head 1 mounted on the carriage 2. Here, when the cap 5 is in contact closely with the recording head 1 in the home position, the discharge ports of the recording head 1 are air-tightly closed against the air outside.

The present embodiment differs from the first embodiment. Here, a reference numeral 10 designates a wiper lever which is driven by a motor (not shown—the aforesaid carriage motor may be applicable) to rotate by means of a cam (not shown) in a manner as shown in FIG. 13 to FIG. 17. On the leading end of the wiper lever 10, a cap wiper 11A for wiping and cleaning the surface of the cap on the recording head side, and a head wiper 11B for cleaning the discharge port surface of the ink jet recording head are installed as a wiping mechanism 11. Usually, the wipers 11A and 11B are formed by a same material (or may be formed by different materials). More specifically, the wipers are flexible rubber blades made of a urethane rubber, silicon rubber or some other appropriate material.

Figure 13:
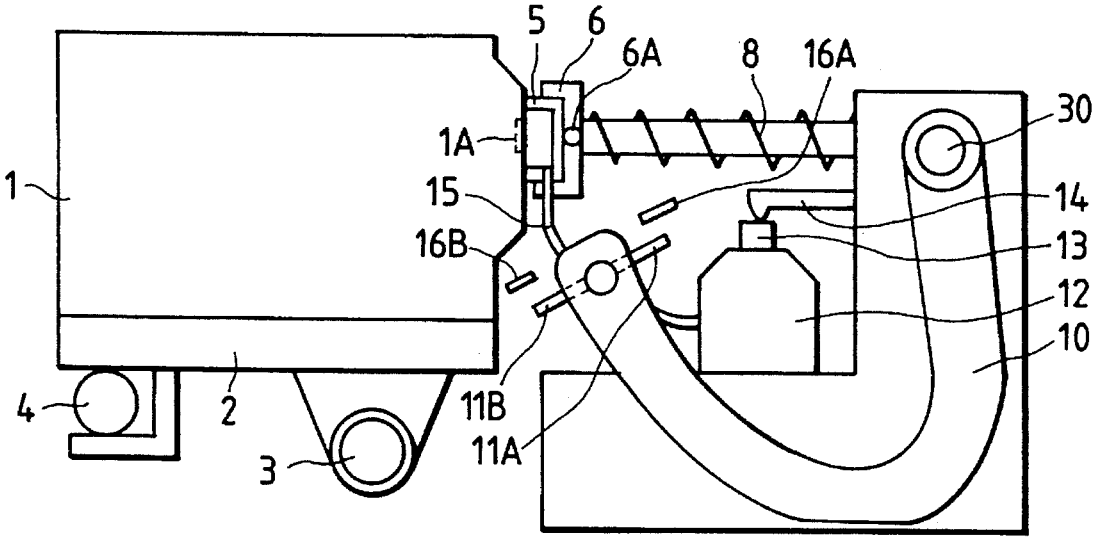
FIG. 13 is a side view showing the state of capping according to the fourth embodiment of the present invention.
Figure 14:
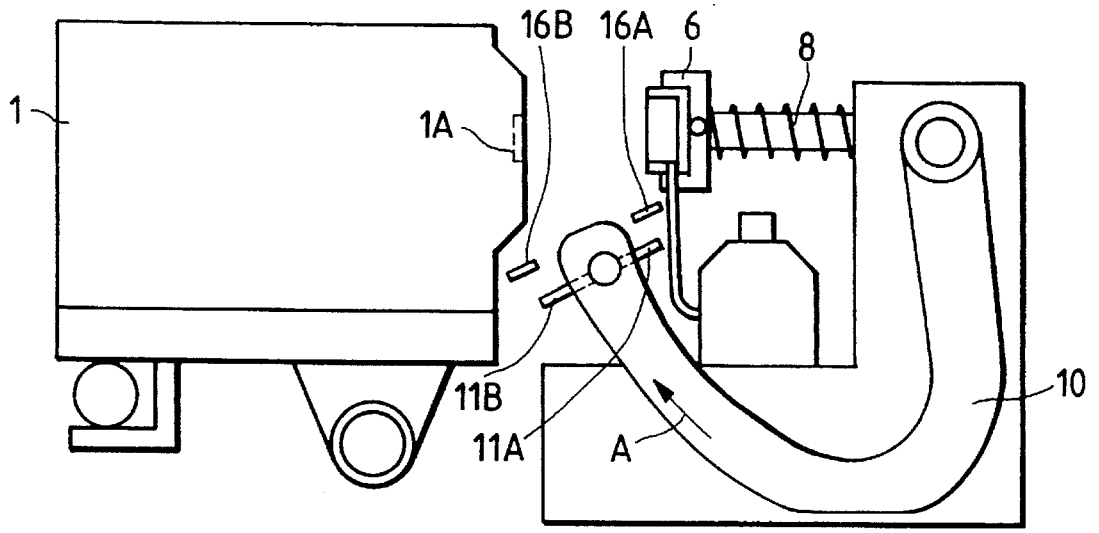
FIG. 14 is a side view showing the state of starting the cleaning of the cap according to the fourth embodiment of the present invention.

Now, with reference to FIG. 13 to FIG. 17, the specific movement of the wiper lever 10, wipers 11A and 11B will be described in detail. FIG. 13 is a view showing the state that the recording head 1 is capped by the cap 5 in the home position. A reference numeral 12 designates a source for generating a negative pressure thereby to suck ink from the ink discharge ports 1A through the tube 15 and cap 5 when the piston 13 is pressed down by the pump lever 14. The wiper lever 10 is rotative around the shaft 30 by means of a cam (not shown). Here, when a signal for wiping operation is transmitted from the central controller CPU (not shown) of the apparatus, the gear 7 shown in FIG. 12 rotates, and then, the cap holder 6 retracts while compressing the spring 8 (see FIG. 14).

Now, by means of a cam (not shown), the wiper lever 10 starts to rotate in the direction indicated by an arrow A. At first, the wipers 11A and 11B abut on the blades 16A and 16B which serve as means for cleaning wipers, respectively. In the present embodiment, a sponge having ink absorption is used for each of the blades 16A and 16B, but a rubber blade or a plastic blade can also be used effectively, of course.

When the wiper lever 10 further rotates in the direction indicated by the arrow A, each of the wipers 11A and 11B pass the blade 16A and 16B, respectively, while being bent under the contacting pressure. Thus the dust particles and other adhesives are scraped off. The amount of overlap between the wipers 11A, 11B, and the blades 16A and 16B should preferably be approximately one mm, but the amount of overlap can be decided for a condition where the stain of the wiper can best be wiped off depending on the material of the wiper and the blade, and also, on the rotational speed of the wiper lever (wiping speed) and others.

Figure 15:
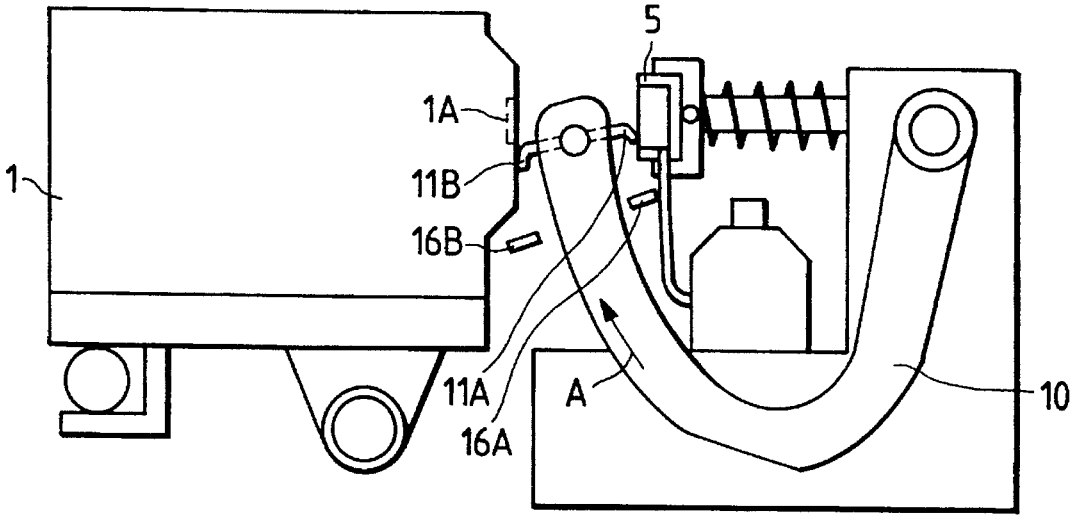
FIG. 15 is a side view showing the state of cleaning the cap according to the fourth embodiment of the present invention.
Figure 16:
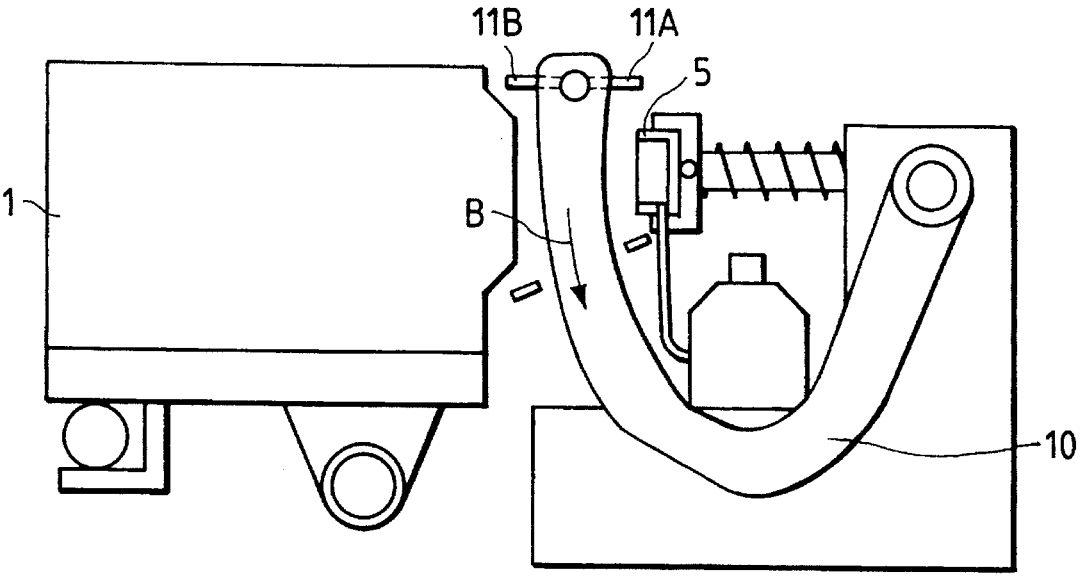
FIG. 16 is a side view showing the state of starting again the cleaning of the cap according to the fourth embodiment of the present invention.
Figure 17:
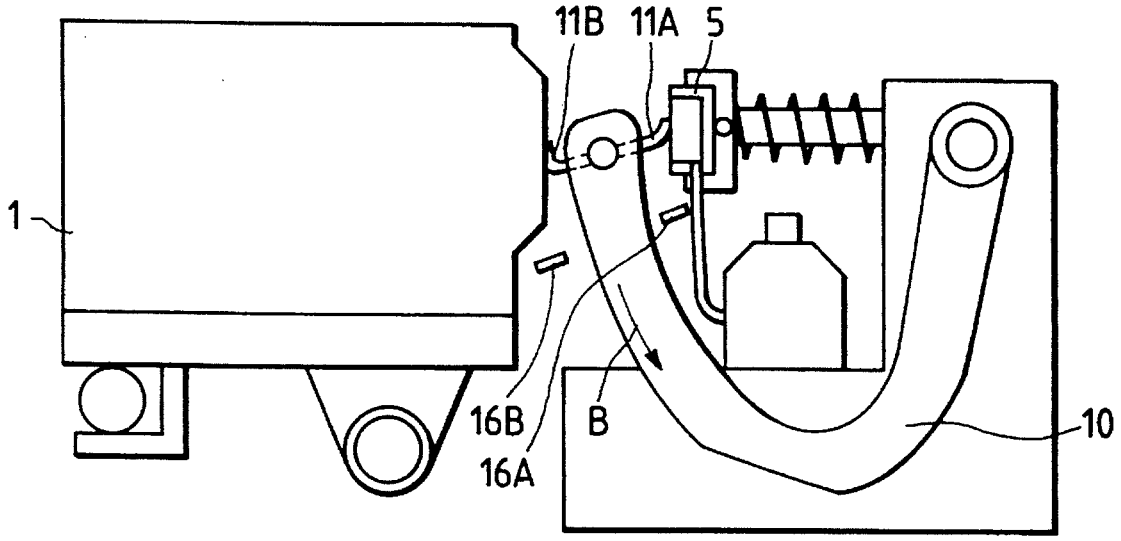
FIG. 17 is a side view showing the state of again cleaning the cap according to the fourth embodiment of the present invention.

Further, when the wiper lever 10 advances in the direction A, the wipers 11A and 11B abut on the cap 5 and the recording head 1, respectively. Rotating further in the direction A, the wiper 11A ascends while wiping the portion where the cap 5 abuts on the recording head 1 (the surface of the cap on the recording head side FA: refer to FIG. 14) from the lower to the upper side of the cap as shown in FIG. 15 while the wiper 11B ascends while wiping the recording head 1 from the lower to the upper side. Then the paper fluffs and dust particles adhering to the surface of the cap on the recording head side and to the discharge port surface of the recording head are removed, respectively. Therefore, both of them are recovered to the good and cleaned state. The amount of overlap between the wipers 11A, 11B, and the cap 5 and the recording head 1 should preferably be approximately one mm, but the amount of overlap can be decided for a condition where the stain of the cap 5 and recording head 1 can best be wiped off depending on the material of the wiper, recording head, and cap, and also, on the rotational speed of the wiper lever (wiping speed) and others.

Further, in the present embodiment, a structure is adopted so that when the wiper lever 10 descends, the surface of the cap on the recording head side and the surface of the head are wiped. The provision of this structure contributes to enhancing the cleaning effect. In other words, when the wiper lever further rotates, and the wipers 11A and 11B arrive at a point above the cap, the rotation of the wiper lever 10 is suspended (see FIG. 16). Then the wiper lever is reversely rotated in the direction indicated by an arrow B by means of a cam (not shown) which is caused to rotate reversely. Therefore, the wipers 11A and 11B descends while wiping the portion where the cap 5 abuts on the recording head 1 (the surface of the cap on the recording head side) FA and the surface of the recording head from the upper to the lower side (see FIG. 17). Then the paper fluffs and dust particles which are not cleaned and still adhere to the surface of the cap on the recording head side and the surface of the recording head are removed by the wiper 11A and 11B, respectively. In this way, these surfaces are recovered to a good and cleaned state more reliably.

In the present embodiment, the structure is arranged so that the wipers 11A and 11B are cleaned by the blades 16A and 16B subsequent to the step of the wipers 11A and 11B having scraped off the dust particle and other adhesives. As a result, the wipers 11A and 11B can be recovered immediately to the state that the wipers can execute the next wiping appropriately. In other words, when the wiper lever 10 further rotates in the direction indicated by the arrow B, the dust particles and others adhering to the wipers 11A and 11B are removed again by the blades 16A and 16B. Then, when the wiper lever 10 returns to the given position, the cap holder 6 advances to cap the recording head 1 with the cap 5 (see FIG. 13).

The surface (sealing surface) of the cap, which abuts on the recording head, and the abutting surface (sealing surface) of the recording head are wiped by only one wiping means by the operation described above. In this way, it is possible to remove the paper fluffs, dust particles, and others adhering to the cap and the recording head, and to secure the airtightness of the recording head at all times when it is closed by capping. Particularly, when a structure is adopted so that the ink discharge port of the recording head is prevented from being dried, and at the same time, the suction is operated for the head in a state of being capped, the suction from the ink discharge ports for recovery can be executed in a sound condition.

Figure 18:
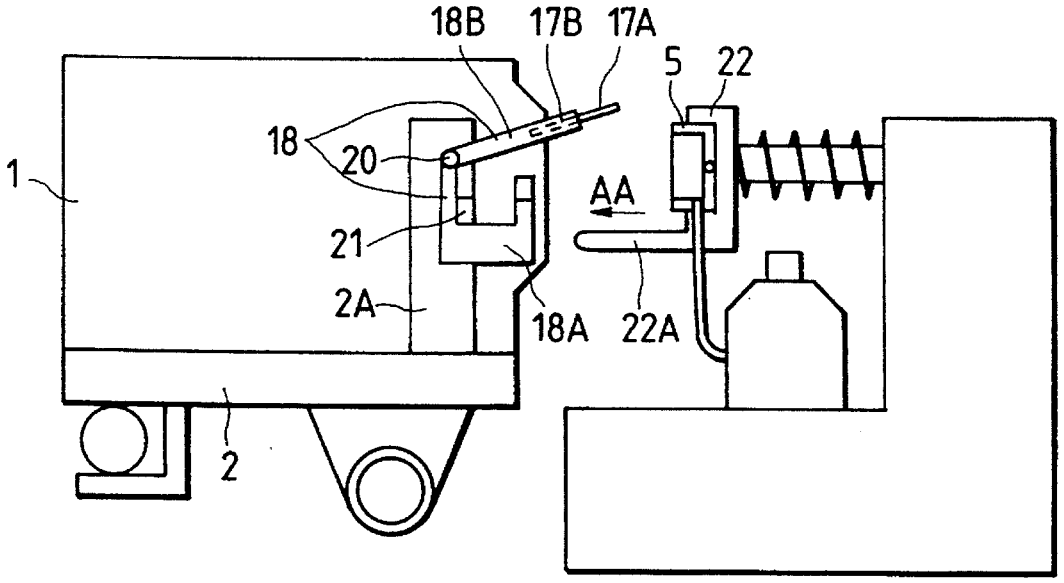
FIG. 18 is a side view showing the state of starting the cleaning of the cap according to the fifth embodiment of the present invention.
Figure 19:
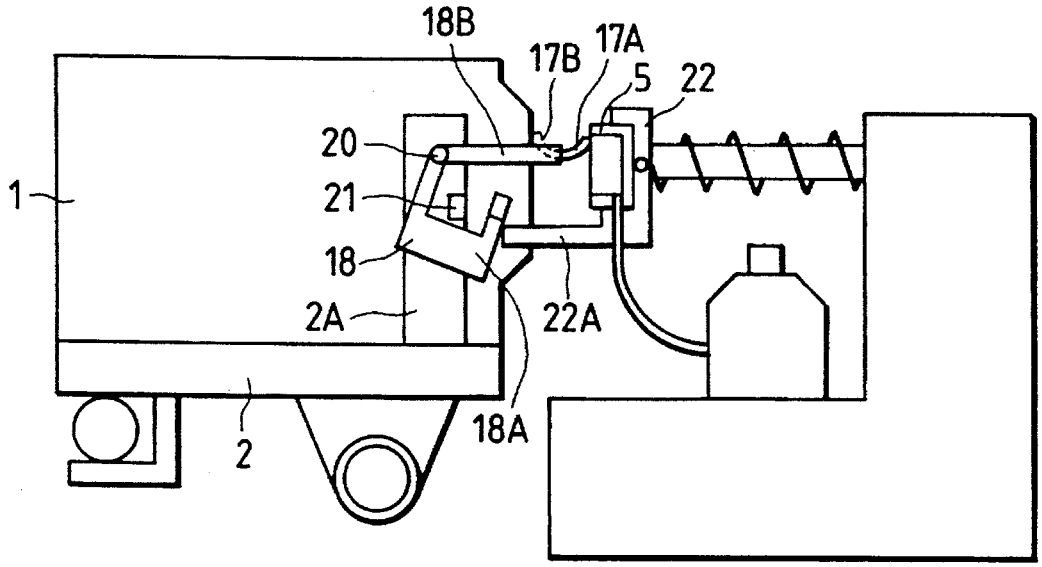
FIG. 19 is a side view showing the state of cleaning the cap according to the fifth embodiment of the present invention.

FIG. 18 and FIG. 19 are views showing a fifth embodiment according to the present invention. The present invention is such that means for cleaning the cap and the recording head of the present invention is mounted on a carriage. Unlike the first embodiment, the surface of the cap on the recording head side FA is wiped only when the cleaning means faces the cap. In this respect, the description will be omitted for the structures which may be shared by the previous embodiments.

In FIG. 18 and FIG. 19, a wiping mechanism 17 is structured in such a manner that as shown in FIG. 18, a wiper lever 18 is formed integrally by a portion 18A in the U-letter form positioned on both side of the head, and a wiper supporting portion 18B at an angle shown in FIG. 18, and that there are mounted on the leading end of the wiper supporting portion of the wiper lever 18, a cap wiper 17A for wiping and cleaning the surface of the cap on the recording head side, and a head wiper 17B for cleaning the discharge port surface of the ink jet recording head. Usually, wipers 17A and 17B are formed by a same material (different materials may be used). More specifically, these are flexible rubber blades, and are formed by a urethane rubber, a silicone rubber, or some other appropriate material.

The cap wiper lever 18 is rotatively supported around the shaft 20 of a supporting pole 2A provided for the carriage 2. In this respect, the wiper lever 18 is biased by means of a twisted coil spring (not shown) so that it can be in the state shown in FIG. 18. By the stopper 21 arranged for the supporting pole 2A, the upper limit of its movement is regulated. As a result, unless an external force is exerted, its rotation is suspended in the position indicated in FIG. 18. The portion 18A in the U-letter form has the extruded parts which are set vertically in a state shown in FIG. 18 in order to receive the external force at the leading ends, and as the cap holder 22 advances, this portion transforms the external force exerted by the advancing extrusion 22A parts into the rotational force so that the entire body of the wiper lever 18 can be rotated clockwise.

Here, when a signal for cap wiping is transmitted form the central controller of the apparatus CPU (not shown), the carriage 19 returns to the home position. The cap holder 22 advances in the direction indicated by an arrow AA. Then the extrusion 22A provided for the cap holder 22 pushes the extrusion of the cap wiper lever 18. The cap wiper lever 18 starts to rotate around the shaft 20. The cap wiper 17A wipes the advancing cap 5, and the wiper 17B wipes the recording head 1 (see FIG. 19). Further, the cap holder 22 still advances, and the surface of the cap 5 on the recording head side is completely cleaned. Then, the cap wipers 17A and 17B move downward from the space between the cap 5 and the recording head. Therefore, the wipers do not interfere with capping. In the present embodiment, the cap and the surface of the recording head which is capped are cleaned without fail before the state of capping is formed, thus eliminating the drawbacks of capping completely.

When a signal for printing is received, and the capping is released, the cap holder 22 retracts. Along this retraction, the cap wiper lever 18 is caused to rotate counterclockwise by means of the twisted coil spring (not shown). In the present embodiment, too, the cap wipers 17A and 17B ascend while wiping the portion of the cap 23 which abuts on the recording head 1 (the surface of the cap on the recording head side) FA and the surface of the recording head from the down to the upper side of these surfaces. In the present embodiment, the wiping mechanism is arranged on the carriage as described above. Then the structure is arranged so that the wiping is driven by the cap holder which moves forward and backward. Compared to the previous embodiment, therefore, the cam and others are no longer needed for the wiping lever, thus enabling the reduction of part numbers, leading to the implementation of cost reduction. Also, the mechanism of the recovery system can be simplified, thus contributing to the enhancement of assembling operation. In this respect, the operational control of the cleaning mechanism on the carriage is carried out by the cap holder according to the present embodiment, but it is to be understood that the adoption of some other driving means and the movement of some other members for this control also fall under the category of the present embodiment.

Figure 20:
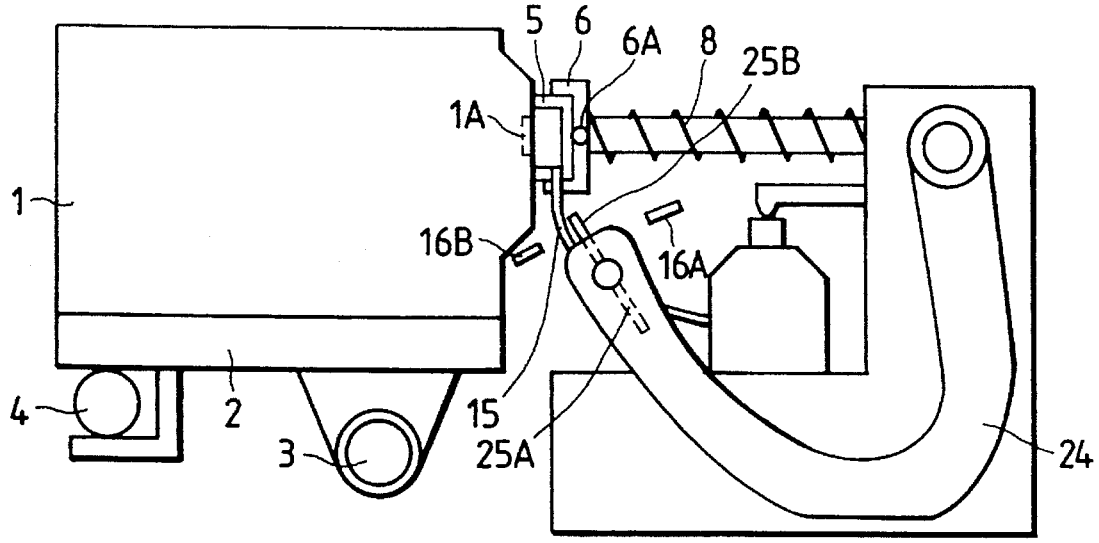
FIG. 20 is a side view showing the state of capping according to the sixth embodiment of the present invention.
Figure 21:
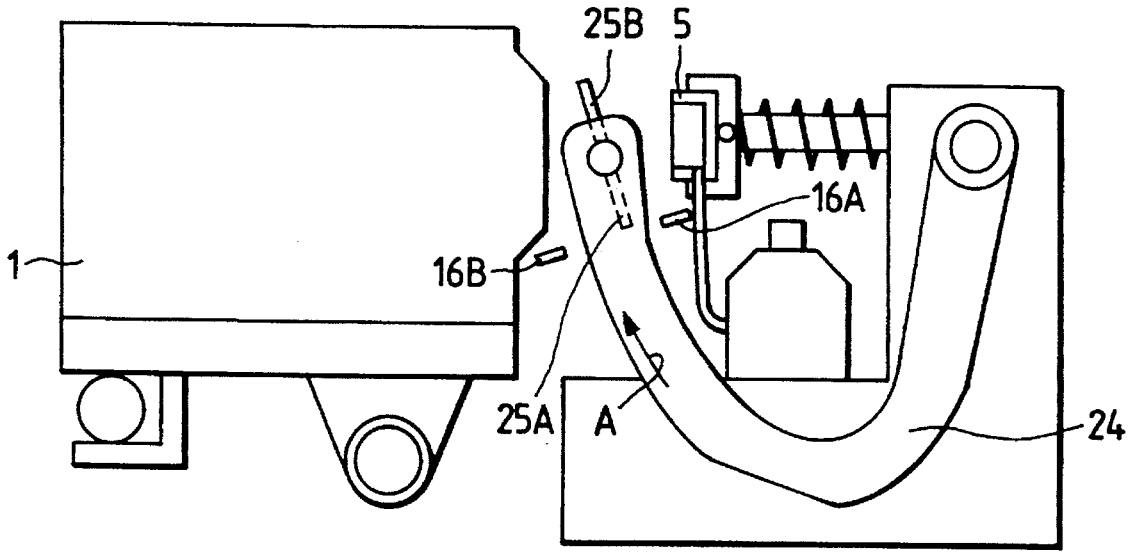
FIG. 21 is a side view showing the preparation stage of cleaning cap according to the sixth embodiment of the present invention.
Figure 22:
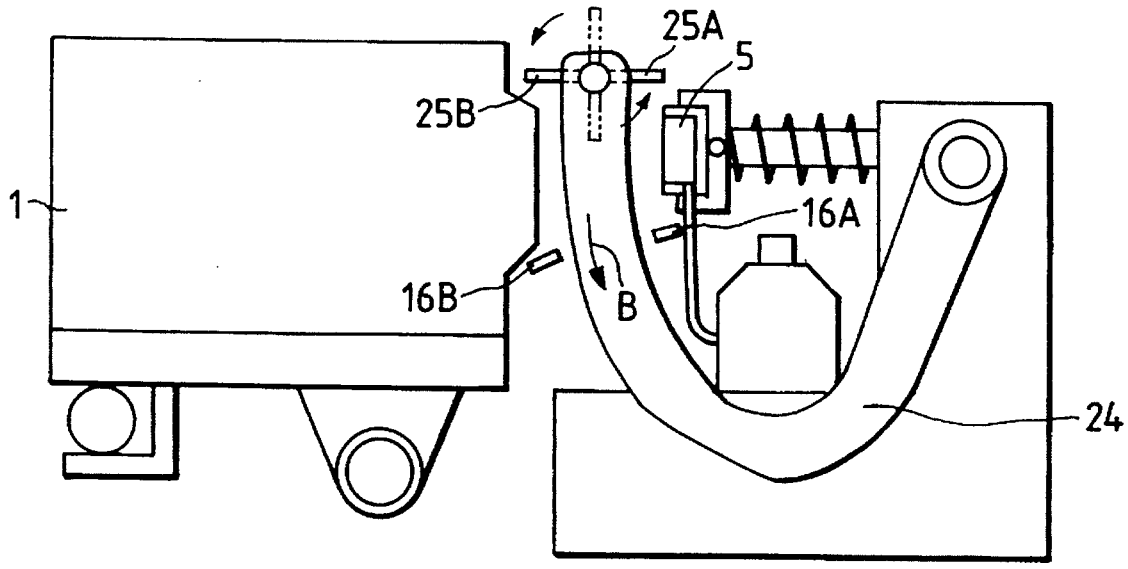
FIG. 22 is a side view showing the state of starting the cleaning of the cap according to the sixth embodiment of the present invention.

Now, FIG. 20 to FIG. 22 are views showing a sixth embodiment according to the present invention. In the present embodiment, what differs from the fourth and fifth embodiments in its structure is that the flight of the dust particles and ink is reduced at the time of cap cleaning by carrying it out only in one direction. Particularly, in the present embodiment, the cap cleaning is executed in the descending process from the upper to the lower side. Here, in the present embodiment, too, the description will be omitted for the structures that may be shared by the previous embodiments.

As shown in FIG. 20 to FIG. 22, when the cap wiper lever 24 is positioned below the cap 5, and the wiper lever 24 is being raised, the wipers 25A and 25B are held along the wiper lever 24. Therefore, the cap 5 and the recording head are not cleaned. In the present embodiment, the wipers 25A and 25B housed in the wiper lever are made ready for cleaning in such a manner that the wipers 25A and 25B in the wiper lever are caused to extrude as shown in FIG. 22 by means of a wiper set lever, for example, which is triggered when the cap lever has arrived at the upper dead point where the rotation of a cam for the movement of the wiper lever is reversed through driving means (not shown). In this state, the wiper lever 24 rotates in the direction B, and then, the wipers 25A and 25B move without any rotation while wiping the portion of the cap which abuts on the recording head 1 (the surface of the cap on the recording head side) FA and the surface of the recording head from the upper to the lower side.

In the present embodiment, the structure is arranged so that the wipers 25A and 25B are cleaned by the blades 16A and 16B subsequent to the step of the wipers 25A and 25B having scraped off the dust particle and other adhesives. As a result, the wipers 25A and 25B can be recovered immediately to the state that the wipers can execute the next wiping appropriately. In other words, when the wiper lever 10 further rotates in the direction indicated by the arrow B, the dust particles and others adhering to the wipers 25A and 25B are removed again by the blades 16A and 16B. Then, the wiper set lever is reset when the cap wiper lever 24 arrives at the lower dead point. The wipers 25A and 25B are again rotate to displace them along the wiper lever 24. Then the recording head is capped by the cap 5 (see FIG. 20).

Here, the cap cleaning can be confined to its execution only in one direction as in the present embodiment. In this way, it is possible to reduce the flight of dust particles and ink significantly when the cap and the recording head are cleaned. Particularly, by conducting the cap cleaning in the process in the upper to the lower side, it is possible to more reliably prevent the dust particles and ink from flying to stain the inside and outside of the apparatus.

Figure 23:
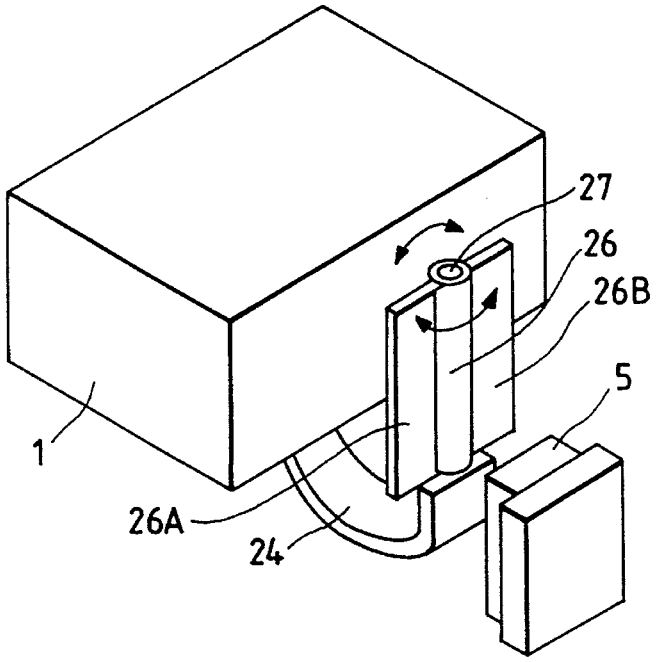
FIG. 23 is a side view showing the state of cleaning the cap according to the sixth embodiment of the present invention.

FIG. 23 is a view showing a seventh embodiment according to the present invention. In the present embodiment, the cap and recording head are wiped by the rotation of a wiper, not by the vertical movement thereof. In FIG. 23, a wiper lever 24 is structured to position the wiper in the space where the wiper can clean the cap and the head, and to retract the wiper from this space to a position so that the capping of the recording head can be performed. The wiper 26 is supported in the cleaning position to reciprocate its rotation substantially in half a round as indicated by arrows in FIG. 23. When the wiper 26 rotates, each of the wiper 26A and wiper 26B, which are arranged on a straight line, wipe the recording head 1 and the cap 5. Here, a structure can be arranged so that the wiper 26A wipes only the recording head 1 while the wiper 26B wipes only the cap 5 by controlling the rotation of the wiper.

In this respect, the wiper is controlled to be in a position where it does not abut on the recording head and the cap at all in the process of shifting the wiper 26 into the space for cleaning the head and cap, and also, in the process of retracting it from this space to a position to make the capping of the recording head possible. In other words, only when the wiper 26 is rotated by a motor, a cam, and others (not shown), the recording head and the cap are cleaned simultaneously or one after another. Thus, by making the wiping rotative, the shifting range of the wiper lever 24 can be minimized. Also, by freely controlling the rotation of the wiper, the number of wiping, the speed of wiping, and others can be selected easily for the enhancement of the cleaning effect with respect to the dust particles and others adhering to the recording head and the cap.

As clear from the description of the above-mentioned embodiments four to seven, there is provided means for cleaning both the recording head and the cap by one wiping operation for an ink jet recording apparatus wherein a resilient cap is pressed to contact the discharge port surface of the recording head, and a recovery device is also arranged to suck ink from the discharge ports by creating a negative pressure in the cap. In this way, dust particles, paper fluffs, and others adhering to both the cap and recording head can be removed. Therefore, no leakage occurs at any time the recording head is capped, hence making it possible to more reliably cap the recording head closely.

Figure 24:
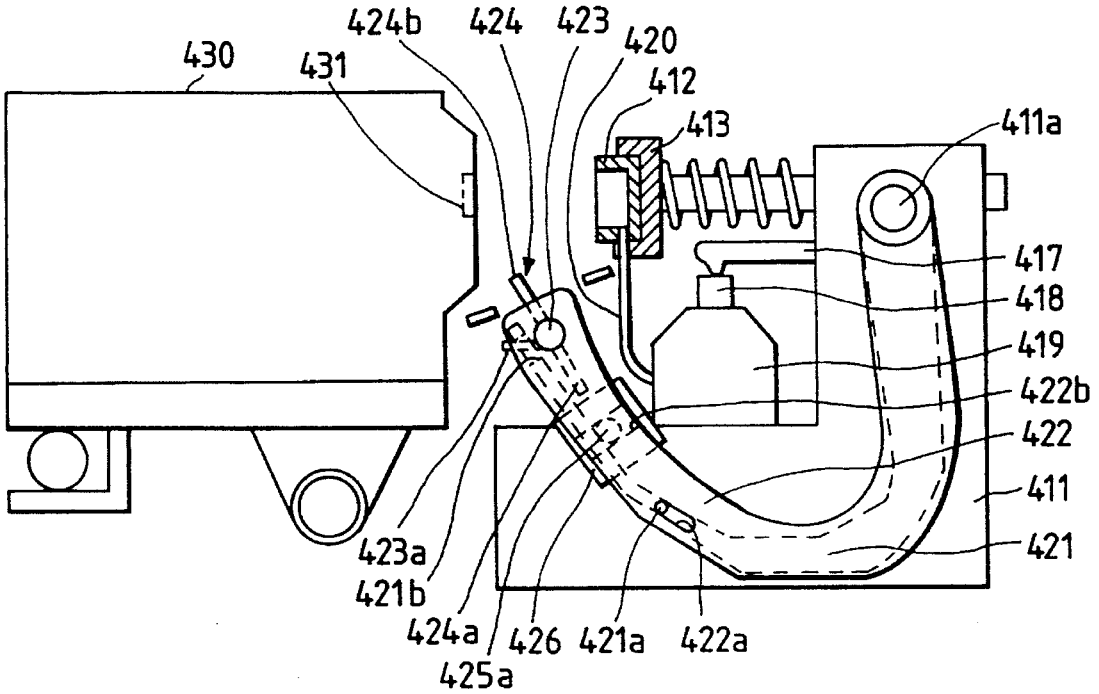
FIG. 24 is a side view of a head recovery unit shown in FIG. 1.

FIG. 24 is a side view showing another embodiment according to the present invention. As shown in FIG. 24, a pump 419 for creating a negative compression is connected to a cap 412 through a tube 420. When the cap 412 is pressed to contact the front surface of a cartridge 430, the piston 418 of the negative compression pump 419 is depressed by a pump lever 417 driven by a cam (not shown). Then a negative pressure is created in the pump 419 to make the suction of ink possible from the discharge ports 32 (see FIG. 33) of the head element 31.

Further, on the side face of a base 411, a wiper set lever 421 and the wiper lever 422, which are both shaped substantially in the U-letter form in observing them from the side, are rotatively provided for a set shaft 411*a* which is integrally arranged on the side face of the base 411. In FIG. 24, the wiper lever 422 is arranged in front, and the wiper set lever 421, behind it. An elongated hole 422*a* is formed on the wiper lever 422, while an extrusion 421*a* is formed on the wiper set lever 421 to slidably fit it into the elongated hole 422*a*. Then an arrangement is made to cause the wiper set lever 421 to rotate by means of a cam (not shown) so that the wiper lever 422 is rotated with a delay along the rotation of the wiper set lever 421.

On the leading end of the wiper lever 422, a wiper holder 423 is rotatively provided. A wiper 424 of a plate type is mounted on the wiper holder 423. The wiper 424 comprises a cap wiping portion 424*a* arranged on the lower side in FIG. 24 with respect to the wiper holder 423, and a head wiping portion 424*b* on the upper side thereto. Usually, the cap wiping portion 424*a* and the head wiping portion 424*b* are formed by a same material. More specifically, these are flexible rubber blades made of a urethane rubber, a silicon rubber or some other material appropriately selected. For the wiper holder 423, a rotary lever 423*a* is provided, which is slidably fitted into a lever groove 421*b* formed on the leading end of the wiper set lever 421. In this way, the wiper 424 is arranged to rotate along the correlative shift of the wiper set lever 421 and the wiper lever 422.

Under the wiper 424, an ink absorbent serving as a cleaner 426 is arranged and held by a cleaner holder (not shown). For the cleaner holder, an extrusion 425*a* is formed to slidably fit into the guide groove 422*b* which formed on the wiper lever 422. Thus the cleaner 426 is made movable along the guide groove 422*b*. Also, the cleaner holder holds the cleaner 426 by a spring (not shown) in a position where the cleaner does not abut on the cap 412 and the head element 431 unless an external force is exerted even when the wiper lever 422 is rotated to shift the cleaner 426 to a position where it faces the cap 412 and the head element 431. As the cleaner 426, it is desirable to adopt a material which has a good water absorption and is soft even when it does not contain water. Usually, a polyurethane resin is used. Further, the cleaner 426 is in contact with a large volume ink absorbent (not shown) arranged in the main body of an ink jet recording apparatus or a head recovery unit when the cleaner 426 is in a position shown in FIG. 24, that is, the wiper set lever 421 is at rest.

Now, the description will be made of the operation of a head recovery unit according to the present embodiment.

Figure 25:
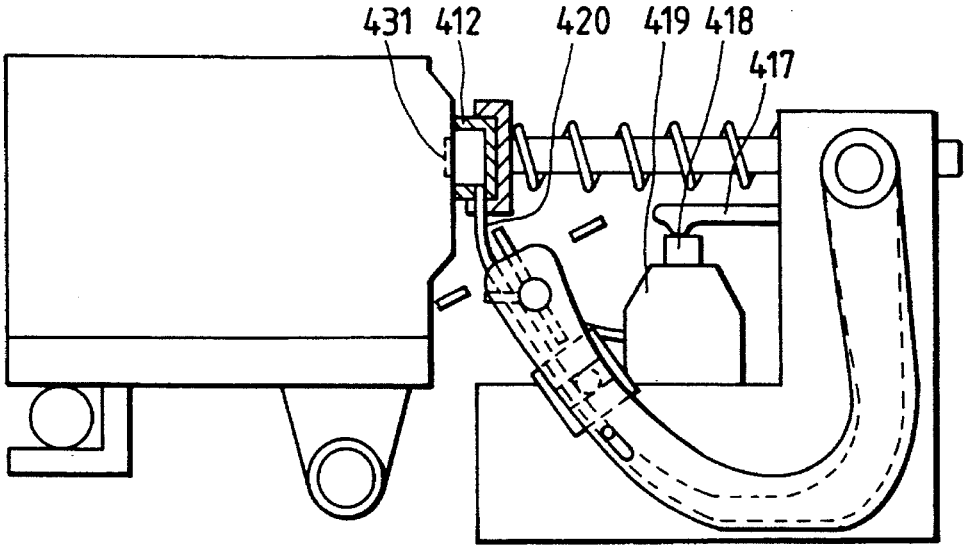
FIG. 25 is a view illustrating the operation of the head recovery unit, and is also a side view showing the state that the head element is capped by a cap.

At first, in the initial state, the carriage 2 is in the home position as shown in FIG. 1. By means of a timing gear 7, the cap holder 413 is caused to advance toward the cartridge 430, and the, as shown in FIG. 25, the head element 431 is capped by the cap 412, thus closing the discharge port surface 431*a* of the head element 431 airtightly.

In this state, when a signal is transmitted from a controller (not shown) for sucking ink, the pump lever 417 is driven to depress the piston 418. A negative pressure is created in the pump 419. In this way, ink is sucked from the discharge ports 432 (see FIG. 33) of the head element 431 through a tube 420.

When the ink is sucked, the timing gear 7 shown in FIG. 1 is rotated to retract the cap holder 413 against the biasing force exerted by a compression coil spring 8. Thus the cap 412 is retracted. FIG. 24 illustrates this state. At this juncture, the discharge port surface 431*a* of the head element 431 and the surface of the cap 412 which abuts on the head element 431 (hereinafter referred to as "sealing surface") are stained by the adhesion ink sucked by the suction of ink.

The ink adhering to the discharge port surface 431*a* of the head element 431 and the sealing surface of the cap 412 are cleaned in the procedures given below.

Figure 26:
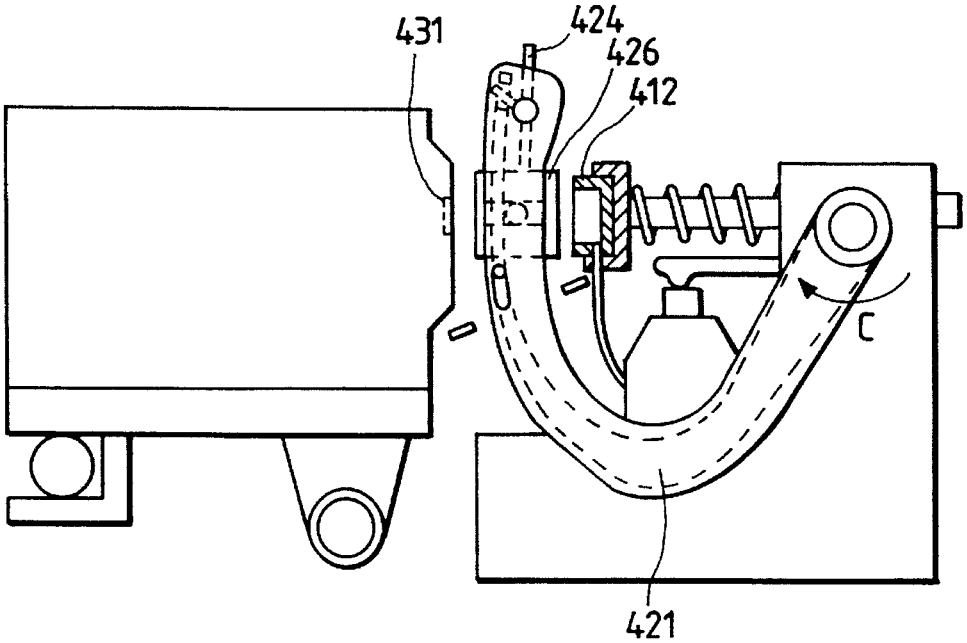
FIG. 26 is a view illustrating the operation of the head recovery unit, and is also a side view showing the state that the cleaner is shifted to a position facing the head element and the cap.

At first, the wiper set lever 421 is caused to rotate in the direction indicated by an arrow C as shown in FIG. 26. The cleaner 426 is shifted to a position facing the head element 431 and the cap 412. In this state, the cleaner 426 does not abut on the head element 431 and the cap 412. Also, before the cleaner 426 arrives at this position, the wiper 424 passes between the head element 431 and the cap 412, but the wiper 424 does not abut on the head element 431 and the cap 412. No wiping is executed then.

Figure 27:
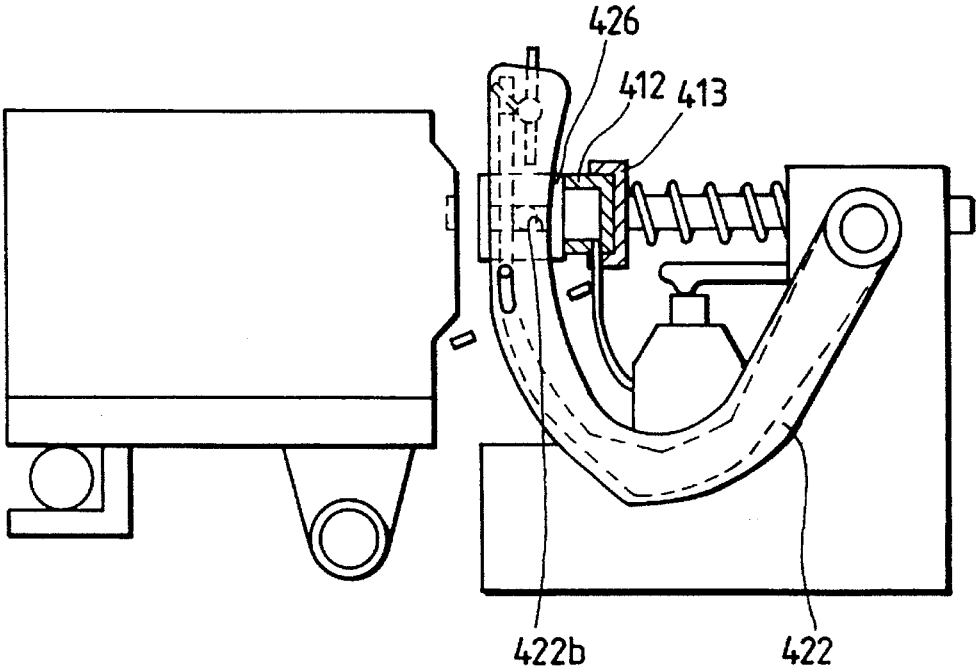
FIG. 27 is a view illustrating the operation of the head recovery unit, and is also a side view showing the state that a cap holder advances from the state shown in FIG. 26 so that the cleaner is pressed to the cap.

When the cleaner 426 is shifted to the position facing the head element 431 and the cap 412, the rotation of the wiper set lever 421 is suspended. Then, as shown in FIG. 27, the cap holder 413 is caused to advance so that the cap 412 is pressed to contact the cleaner 426. In this way, the ink adhering to the sealing surface of the cap 412 is absorbed into the cleaner 426.

Figure 28:
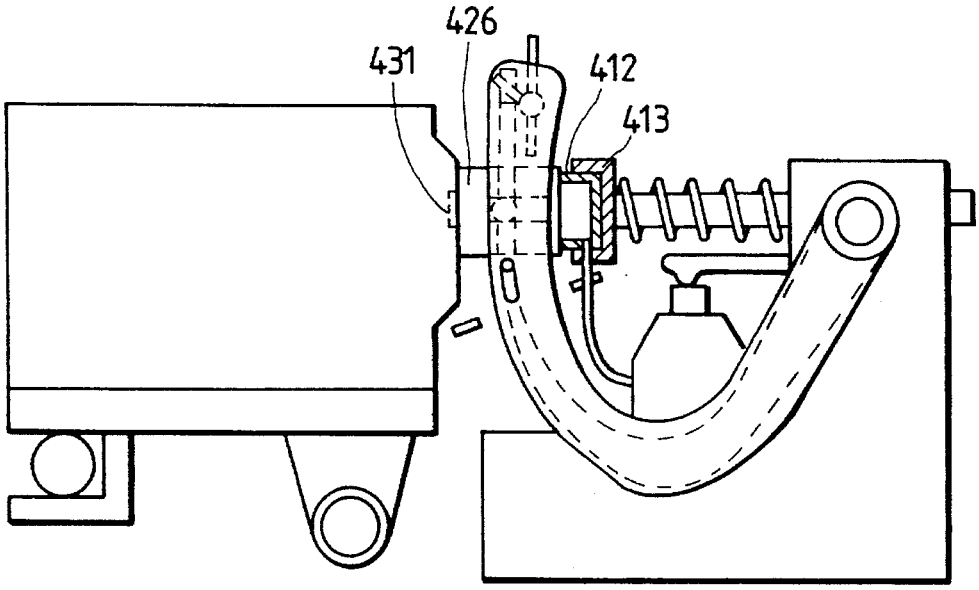
FIG. 28 is a view illustrating the operation of the head recovery unit, and is also a side view showing the state that the cap holder further advances from the state shown in FIG. 27 so that the cleaner is pressed to the head element.

Also, as described above, the cleaner 426 is arranged to be movable along the guide groove 422*b* formed on the wiper lever 422. Therefore, when the cap holder 413 further advances, the cleaner 426 can be depressed to the discharge port surface 31*a* (see FIG. 33) of the head element 431 as shown in FIG. 28. As a result, at the same time that the ink adhering to the sealing surface of the cap 412 is absorbed, the ink adhering to the discharge port surface 431*a* of the head element 431 is absorbed to the cleaner 426. The ink absorbed to the cleaner 426 is absorbed into the aforesaid ink absorbent when the cleaner 426 returns to the original position where it can contact this ink absorbent after the completion of a series of the head recovery unit. Consequently, the cleaner 426 is not saturated with ink, hence maintaining the capability of ink absorption at all times.

As described above, the ink adhering to the sealing surface of the cap 412 and the discharge port surface 431*a* of the head element 431 is absorbed by the cleaner 426. Therefore, when the head element 431 is again capped by the cap 412, there is no ink adhesion from the head element 431 to the cap 412, and also, from the cap 412 to the head element 431. No ink adheres to the contacting surfaces of the cap 412 and the head element 431. As a result, when a cartridge containing ink of a different color is mounted subsequently, and the head element thereof is capped, there is no possibility that any ink of different color from other cartridge adheres to the head element through the cap. Supposing that the cleaner 426 can not absorb the ink adhering to the cap 412 completely, the amount of ink remaining on the cap 412 is extremely small. Therefore, even if the head element for ink of different color is capped in such a state, there is no possibility that the ink flows into the discharge ports from the cap during recording, thus preventing the mixture of ink colors from taking place. When the ink adhering to the head element 431 and the cap 412 is absorbed by the cleaner 426, the cap holder 413 is retracted to release the depression exerted by the cap 412 on the cleaner 426. Then the cleaner 426 returns by means of the spring (not shown) to the position shown in FIG. 26. The depression exerted by the cleaner 426 on the head element 431 is also released.

Figure 29:
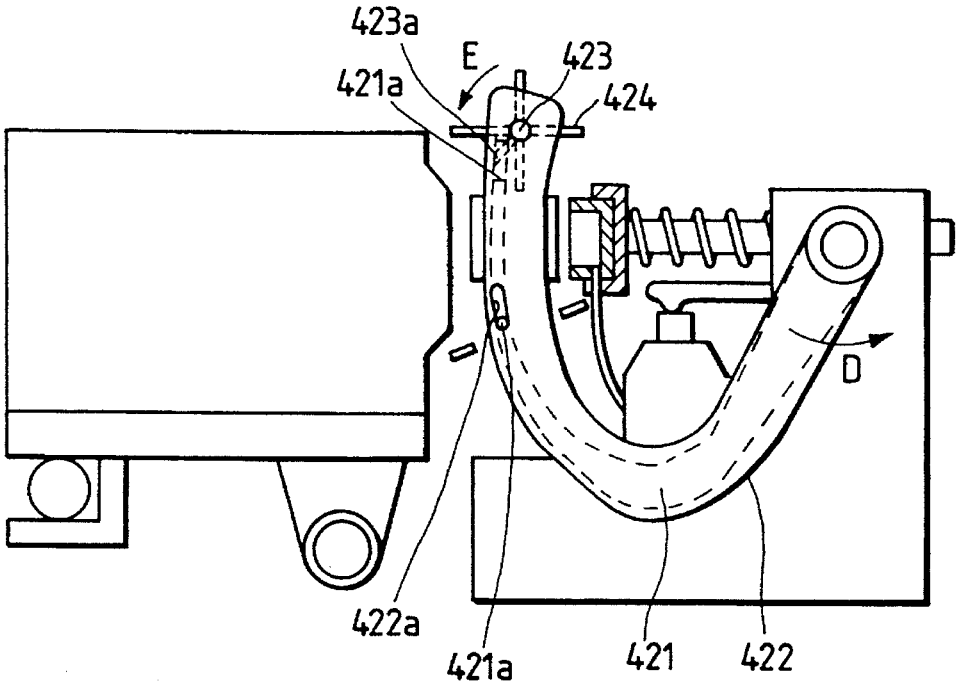
FIG. 29 is a view illustrating the operation of the head recovery unit shown in FIG. 1, and is also a side view showing the state that a wiper rotates in the state represented in FIG. 28.

Subsequently, as shown in FIG. 29, the wiper set lever 421 is caused to rotate in the direction indicated by an arrow D. Then, since the extrusion 421*a* of the wiper set lever 421 is slidable along the elongated hole 422*a* of the wiper lever 422, the wiper lever 422 does not rotate within a range that this extrusion 421*a* can slide even when the wiper set lever 421 is rotated. As a result, the rotary lever 423*a* of the wiper holder 423 is pressed downward in FIG. 29 due to the lever groove 421*a*. Along this movement, wiper 424 is rotated substantially at 90° in the direction indicated by an arrow E.

Figure 30:
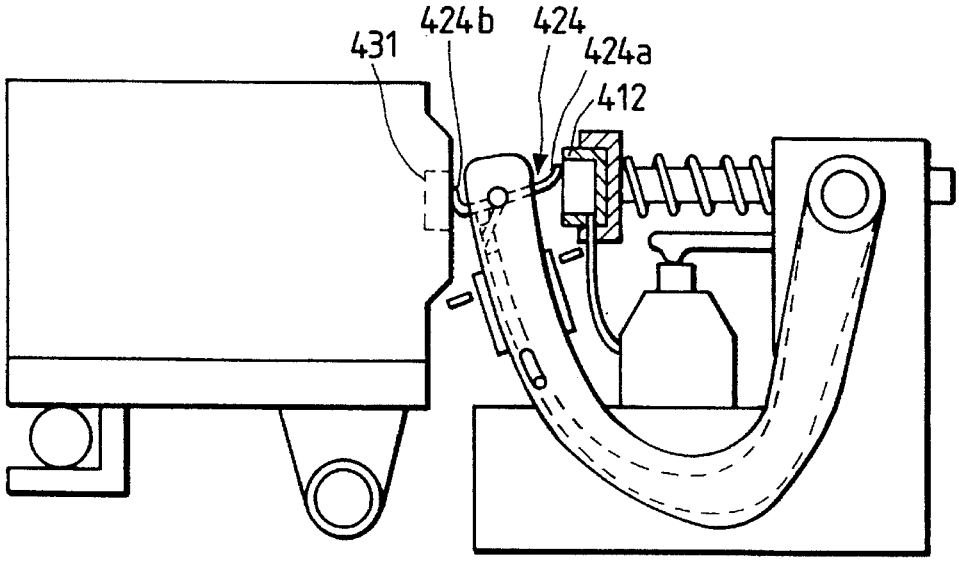
FIG. 30 is a view illustrating the operation of the head recovery unit shown in FIG. 1, and is also a side view showing the state of wiping.

Then, as the wiper set lever 421 is further rotated in the direction indicated by the arrow D, the wiper 424 passes between the head element 431 and the cap 412 while the head wiping portion 424*b* and the cap wiping portion 424*a* being bent by the contacting pressure exerted by the head element 431 and the cap 412, respectively, in wiping them as shown in FIG. 30. In this way, it is possible to remove the dust particles, paper fluffs, and others adhering to the discharge port surface 431*a* (see FIG. 33) and the sealing surface of the cap 412.

In the present embodiment, ink adhering to each of the head elements 431 of cartridges 430 of different colors and to one cap 412 is absorbed by one cleaner 426, but it is possible to prevent ink colors from being mixed more efficiently by providing a plurality of clears each arranged individually per color for the cartridges 430 of different colors. More specifically, in a case of ink jet recording apparatus which uses monochromatic inks in red and black, respectively, a cleaner for use of black color, and a cleaner for use of red color are arranged. Then ink adhering to the head element and the cap are absorbed by use of the cleaner corresponding to the color ink used by that particular cartridge, thereby to prevent the ink colors from being mixed more efficiently. In this case, it may be possible to detect the color of ink used by the cartridge automatically by means of the main body of the apparatus or to set it by changing dip switches among some other means.

Also, in a case of a full-color ink jet recording apparatus which uses four ink colors, yellow, cyan, magenta, and black, the same is applicable. Four cleaners are prepared for each of the colors, and by controlling the use of the cleaners in accordance with the color of ink to be absorbed, it is possible to prevent the ink colors from being mixed more reliably.

Further, in the present embodiment, the cleaner 426 is to absorb ink adhering to the cap 412 and the head element 431 as well, but it may be possible to arrange a cleaner for use of only the cap 412 or of the head element 430.

Figure 31:
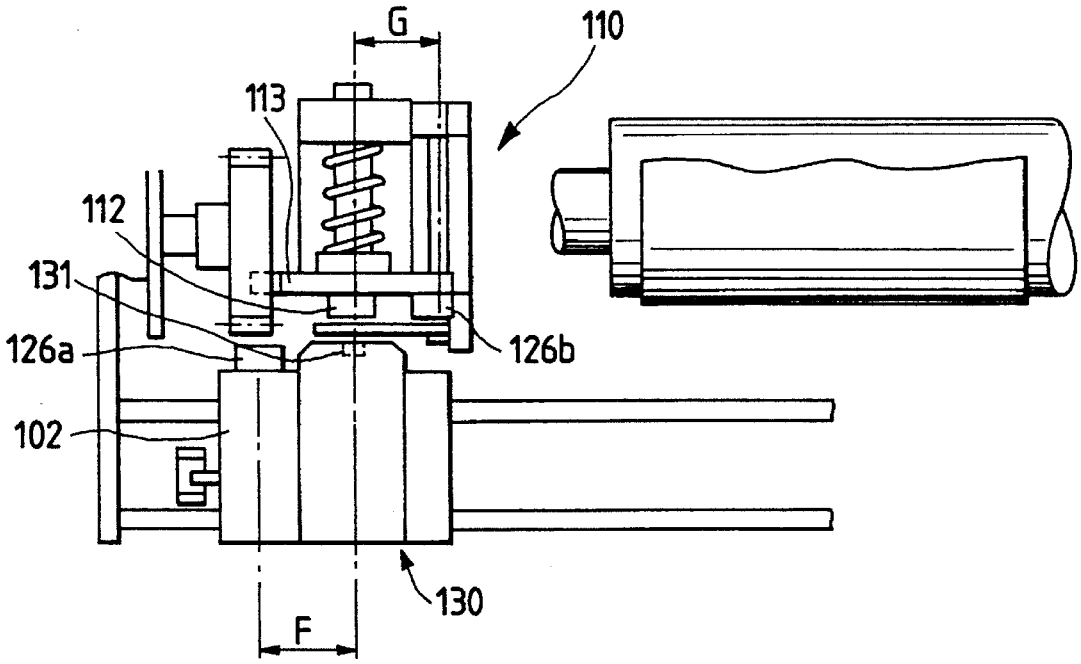
FIG. 31 is a plan view schematically showing the vicinity of a head recovery unit according to another embodiment of the ink jet recording apparatus of the present invention.

FIG. 31 is a plan view schematically showing the vicinity of the head recovery unit of another embodiment for an ink jet recording apparatus according to the present invention. The head recovery unit 110 according to the present embodiment comprises a first cleaner 126*a* arranged on the left-hand end of the carriage 102 in FIG. 31 for absorbing ink adhering to the cap 112, and a second cleaner 126*b* arranged on the right-hand end of the cap holder 113 for absorbing ink adhering to the end element 131 of the cartridge 130. The first and second cleaners 126*a* and 126*b* are arranged so that the distance F from the center of the first cleaner 126*a* to the center of the head element 131 and the distance G from the center of the cap 112 to the center of the second cleaner 126*b* are substantially equal. Any other structures may be the same as those described in the previous embodiments. Therefore, the description thereof will be omitted.

When a signal for sucking ink is transmitted from the controller (not shown) in accordance with the arrangement described above, the cap holder 113 is caused to advance when the carriage 102 is in the home position (the position shown in FIG. 31) as in the previous embodiments. The head element 131 is capped by the cap 112 for sucking ink. Subsequently, the cap holder 113 is retracted. At this juncture, the ink adheres to the cap 112 and head element 131, which should be absorbed, respectively.

Figure 32:
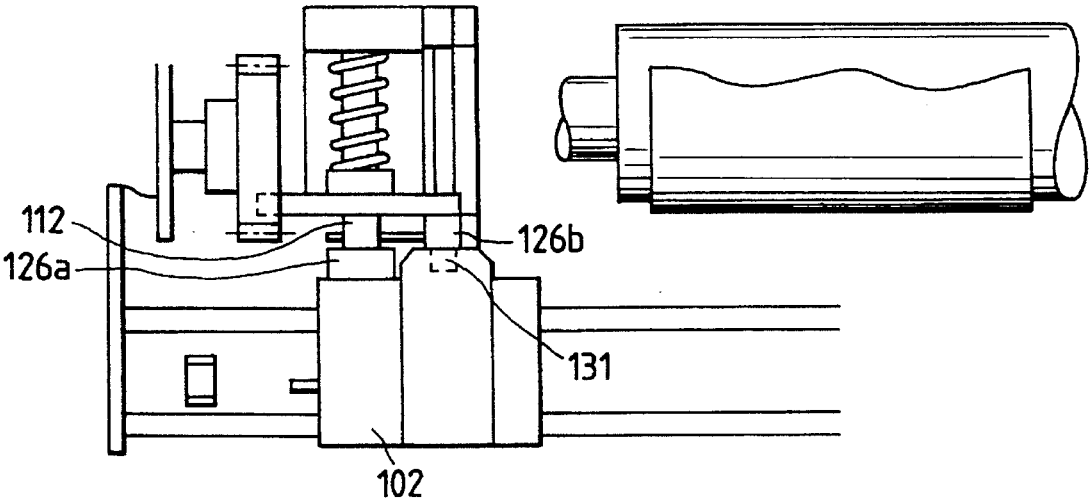
FIG. 32 is a plan view schematically showing the state that ink adhering to the cap and heat element is being absorbed by each of the cleaners, respectively, in the ink jet recording apparatus shown in FIG. 31.

Subsequently, the carriage 102 is moved only for the distance F (G) in the direction to the right in FIG. 31. Thus the first cleaner 126*a* arrives at a position facing the cap 112. The head element 131 also arrives at a position facing the cleaner 126*b*. In this state, the cap holder 113 is caused to advance. Then, as shown in FIG. 32, the cap 112 abuts on the first cleaner 126*a*, and at the same time, the head element 131 abuts on the second cleaner 126*b*. The ink adhering to the cap 112 and the head element 131 is thus absorbed by the first cleaner 126*a* and the second cleaner 126*b*, respectively.

Subsequently, the carriage 102 returns to the home position where the head element 131 is wiped. Then, after a predischarge is executed, the head element is capped. At this juncture, no ink adheres to the cap 112 and the head element 131. Therefore, any color mixing takes places when the next cartridge having ink of different color is mounted and the head element of this cartridge is capped.

As described above, by dividing the cleaner to the one for the use of cap 112, and the other for the use of head element 131. The volume of each cleaner can be increased to enhance its absorbing capability of ink. Also, the traveling mechanism and the mounting mechanism are simple. The design flexibility is increased, accordingly. According to the present embodiment, too, it is possible to more reliably prevent the ink colors from being mixed by arranging the cleaners per ink color to be used as in the previous embodiments.

In this respect, the present invention produces an excellent effect on the recording head and recording apparatus which uses an ink jet recording method, particularly those which utilize thermal energy to form flying droplets for recording.

Regarding the typical structure and operational principle of such a method, it is preferable to adopt the method to be implemented by use of the fundamental principle disclosed in the specifications of U.S. Pat. Nos. 4,723,129 and 4,740,796. This method is applicable to the so-called on-demand type recording system as well as to a continuous type recording system. Particularly, however, it is suitable for the on-demand type because the principle is such that at least one driving signal, which provides a rapid temperature rise beyond a departure from nucleation boiling point in response to recording information, is applied to an electrothermal transducer disposed on a liquid (ink) retaining sheet or liquid passage whereby to cause the electrothermal transducer to generate thermal energy to produce film boiling on the thermo-active portion of the recording head; thus effectively leading to the resultant one to one formation of a bubble in the recording liquid (ink) for each of the driving signals. By the development and contraction of the bubble, the liquid (ink) is discharged through a discharging port to produce at least one droplet. The driving signal is preferably in the form of pulses because the development and contraction of the bubbles can be effectuated instantaneously, thus discharging the liquid (ink) with particularly quick responses.

The driving signal in the form of pulses is preferably such as disclosed in the specifications of U.S. Pat. Nos. 4,463,359 and 4,345,262. In this respect, it is possible to execute an excellent recording in a better condition if the rate of the temperature increase of the heating surface is adopted as disclosed in the specification of U.S. Pat. No. 4,313,124.

The structure of the recording head may be as shown in each of the above-mentioned specifications wherein the structure is arranged to combine such discharge ports, liquid passages, and electrothermal transducers as disclosed in the specifications (linear type liquid passage or right angle liquid passage). Here, there is also included in the present invention, a structure such as disclosed in the specifications of U.S. Pat. Nos. 4,558,333 and 4,459,600 wherein the portions thermally activated are arranged in a curved area.

In addition, the present invention is effectively applicable to the structure disclosed in Japanese Laid-Open Application No. 59-123670 wherein a common slit is used as the discharging ports for plural electrothermal transducers, and to the structure disclosed in Japanese Patent Laid-Open Application No. 59-138461 wherein an aperture for absorbing pressure wave of the thermal energy is formed corresponding to the discharging ports.

Further, as a full-line type recording head having a length corresponding to the maximum width of a medium which can be recorded by a recording apparatus, it is possible to adopt either such a type that may be structured by combining a plurality of the recording heads disclosed in the above-mentioned specifications to satisfy the required length or a single recording head which is integrally formed as a full-line use.

In addition, the present invention is effectively applicable to a replaceable chip type recording head which is electrically connected with the main body of the apparatus, and to which the ink is supplied when it is installed in the main assembly; or to a cartridge type recording head having an ink tank integrally provided for the head itself.

Also, it is preferable to additionally provide means for recovering the recording head, and preliminarily auxiliary means as constituents of the recording apparatus according to the present invention because these additional means will contribute to making the effectiveness of the present invention more stabilized. To name them specifically, such constituents are electrothermal transducers or heating elements other than such transducers or preliminary heating means provided by the combination of those elements.

In the embodiments according to the present invention described above, while the ink has been described as liquid, it may be an ink material which is solidified below the room temperature but liquefied at the room temperature. Since the ink is controlled within the temperature not lower than 30° C. and not higher than 70° C. in order to stabilize its viscosity for the provision of the stable discharge in general, the ink may be such that it can be liquefied when the applicable recording signals are given.

In addition, while positively preventing the temperature rise due to the thermal energy by the use of such energy as an energy consumed for changing states of ink from solid to liquid, or using the ink which will be solidified when left intact for the purpose of preventing the ink from being evaporated, it may be possible to adopt for the present invention the use of an ink having a nature of being liquefied only by the application of thermal energy, such as an ink capable of being discharged as ink liquid by enabling itself to be liquefied anyway when the thermal energy is given in accordance with recording signals, and an ink which will have already begun solidifying itself by the time it reaches a recording medium. In such a case, it may be possible to retain the ink in the form of liquid or solid in the recesses or through holes of a porous sheet such as disclosed in Japanese Patent Laid-Open application No. 54-56847 or 60-71260 so that the ink retained in such a form can face the electrothermal transducers. For the present invention, the most effective method applicable to the various kinds of ink described above is the method in which the aforesaid film boiling is made executable.

Furthermore, as the mode of the recording apparatus according to the present invention, it may be possible to adopt a copying apparatus combined with a reader in addition to the image output terminal which is integrally or independently provided for a word processor, computer, or other information processing apparatus. Also, it may be possible to adopt among others a mode of a facsimile apparatus having transmission and reception functions.

What is claimed is:

1. A recovery mechanism for an ink jet apparatus having a cap for capping a discharge port of an ink jet head, comprising:

cap cleaning means for cleaning a surface of the cap which opposes a surface of the head having the discharge port, said cap cleaning means comprising a blade; and head cleaning means for cleaning the surface of the head having the discharge port, wherein said cap cleaning means and said head cleaning means can be positioned at a location between the head and the cap when said surface of the head is opposed to said surface of the cap so that at said location cleaning of both said surface of the cap and said surface of the head are performed in parallel.

2. A recovery mechanism for an ink jet apparatus according to claim 1 wherein said mechanism has control means for executing the cleaning of said surface of the cap by said cap cleaning means before the capping of the discharge port by the cap.

3. A recovery mechanism for an ink jet apparatus according to claim 1, further comprising blade cleaning means for cleaning said blade.

4. A recovery mechanism for an ink jet apparatus according to claim 3 wherein the blade cleans said surface of the cap while moving from an upper portion of said surface to a lower portion of said surface.

5. A recovery mechanism for an ink jet apparatus according to claim 1, wherein the blade cleans said surface of the cap while moving from an upper portion of said surface to a lower portion of said surface.

6. A recovery mechanism for an ink jet apparatus according to claim 1, wherein said cap cleaning means further comprises an ink absorbent contacting said surface of the cap.

7. A recovery mechanism for an ink jet apparatus according to claim 8 wherein said ink absorbent also contacts said surface the ink jet head.

8. A recovery mechanism for an ink jet apparatus having a cap for capping a discharge port of an ink jet head, comprising:

cap cleaning means for cleaning a surface of the cap which opposes a surface of the head having the discharge port, said cap cleaning means comprising a blade;

means for sucking an interior of the cap after said cap cleaning means cleans said surface of the cap; and head cleaning means for cleaning the surface of the head having the discharge port, wherein said cap cleaning means and said head cleaning means can be positioned at a location between the head and the cap when said surface of the head is opposed to said surface of the cap so that at said location cleaning of both said surface of the cap and said surface of the head are performed in parallel.

9. An ink jet apparatus having an ink jet head, and a cap for capping a discharge port of an ink jet head, comprising:

cap cleaning means for cleaning a surface of the cap which faces a surface of the head having the discharge port, said cap cleaning means comprising a blade; and head cleaning means for cleaning the surface of the head having the discharge port, wherein said cap cleaning means and said head cleaning means can be positioned at a location between the head and the cap when said surface of the head is opposed to said surface of the cap so that at said location cleaning of both said surface of the cap and said surface of the head are performed in parallel.

10. An ink jet apparatus according to claim 9 wherein said apparatus has sucking means for executing suction from the discharge port of the ink jet head while said ink jet head is capped by the cap.

11. An ink jet apparatus according to claim 9 wherein said mechanism has control means for executing the cleaning of said surface of the cap by said cap cleaning means before the capping of the discharge port by the cap.

12. An ink jet apparatus according to claim 9, further comprising blade cleaning means for cleaning said blade.

13. An ink jet apparatus according to claim 12, wherein the blade cleans said surface of the cap while moving from an upper portion of said surface to a lower portion of said surface.

14. An ink jet apparatus according to claim 9, wherein the blade cleans said surface of the cap while moving from an upper portion of said surface to a lower portion of said surface.

15. An ink jet apparatus according to claim 9, wherein said cleaning means further comprises an ink absorbent contacting said surface of the cap.

16. An ink jet apparatus according to claim 15, wherein said ink absorbent also contacts said surface of the ink jet head.

17. An ink jet apparatus according to claim 9, wherein electrothermal transducers are provided for said ink jet head for generating thermal energy to discharge ink from said discharge port.

18. An ink jet apparatus according to claim 17 wherein said ink jet head utilizes the film boiling created in ink by the thermal energy generated by said electrothermal transducers.

* * * * *

UNITED STATES PATENT AND TRADEMARK OFFICE

CERTIFICATE OF CORRECTION

PATENT NO. : 5,608,432

DATED : March 4, 1997

INVENTOR(S) : Hideki Yamaguchi

It is certified that error appears in the above-identified patent and that said Letters Patent is hereby corrected as shown below: On the title page:

AT [56] REFERENCES CITED

Foreign Patent Documents,
"9045162 3/1984 Japan" should read
--59-45162 3/1984 Japan--.

COLUMN 1

Line 31, "Jet" should read --jet--.

COLUMN 2

Line 17, "works" should read --work--.
Line 55, "but" should be deleted.

COLUMN 3

Line 2, "a" should be deleted.
Line 28, "cartridge" should read --cartridges--.

COLUMN 6

Line 6, "while" should be deleted.
Line 27, "ink" should read --inks--.

COLUMN 10

Line 6, "urethan" should read --urethane--.
Line 14, "such" should read --suck--.
Line 17, "means" should read --means of--.

UNITED STATES PATENT AND TRADEMARK OFFICE

CERTIFICATE OF CORRECTION

PATENT NO. : 5,608,432

DATED : March 4, 1997

INVENTOR(S) : Hideki Yamaguchi

It is certified that error appears in the above-identified patent and that said Letters Patent is hereby corrected as shown below:

COLUMN 11

Line 55, "form" should read --from--.

COLUMN 12

Line 64, "As" should read --As is--.

COLUMN 15

Line 5, "descends" should read --descend--.
Line 12, "wiper" should read --wipers--.
Line 18, "particle" should read --particles--.
Line 53, "side" should read --sides--.
Line 60, "by" should read --from--.
Line 62, "by" should read --from--.

COLUMN 16

Line 12, "form" should read --from--.
Line 37, "surfaces. In" should read --surfaces. ¶ In--.

COLUMN 17

Line 18, "particle" should read --particles--.
Line 26, "rotate" should read --rotated--.

COLUMN 18

Line 1, "As" should read --As is--.
Line 54, "which" should read --which is--.

UNITED STATES PATENT AND TRADEMARK OFFICE

CERTIFICATE OF CORRECTION

PATENT NO. : 5,608,432

DATED : March 4, 1997

INVENTOR(S) : Hideki Yamaguchi

It is certified that error appears in the above-identified patent and that said Letters Patent is hereby corrected as shown below:

COLUMN 19

Line 8, "and the," should read --and--.

COLUMN 20

Line 12, "When" should read --¶ When--.

COLUMN 21

Line 40, "places" should read --place--.
Line 45, "131. The" should read --131, the--.

COLUMN 22

Line 5, "head; Thus" should read --head, thus--.

COLUMN 23

Line 49, "claim 1" should read --claim 1,--.
Line 57, "claim 3" should read --claim 3,--.

UNITED STATES PATENT AND TRADEMARK OFFICE

CERTIFICATE OF CORRECTION

PATENT NO. : 5,608,432

DATED : March 4, 1997

INVENTOR(S) : Hideki Yamaguchi

It is certified that error appears in the above-identified patent and that said Letters Patent is hereby corrected as shown below:

COLUMN 24

Line 2, "claim 8" should read --claim 6,
Line 3, "surface" should read --surface of--.
Line 34, "claim 9" should read --claim 9,--.
Line 38, "claim 9" should read --claim 9,--.
Line 62, "claim 17" should read --claim 17,--.

Signed and Sealed this

Sixth Day of January, 1998

*Attest:*

Bruce Lehman

BRUCE LEHMAN

*Attesting Officer*

*Commissioner of Patents and Trademarks*